US008584607B2

(12) United States Patent
Tokura

(10) Patent No.: US 8,584,607 B2
(45) Date of Patent: Nov. 19, 2013

(54) SEWING MACHINE

(75) Inventor: Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/596,998

(22) Filed: Aug. 28, 2012

(65) Prior Publication Data

US 2013/0081562 A1 Apr. 4, 2013

(30) Foreign Application Priority Data

Sep. 29, 2011 (JP) ..... 2011-213731

(51) Int. Cl.
*D05B 19/00* (2006.01)

(52) U.S. Cl.
USPC ..... 112/470.01; 112/102.5; 700/138

(58) Field of Classification Search
USPC ..... 112/470.01, 470.03, 470.04, 470.06, 112/78, 102.5, 475.18, 475.19; 700/136–138
See application file for complete search history.

(56) References Cited

U.S. PATENT DOCUMENTS 5,855,176 A * 1/1999 Takenoya et al. ..... 112/102.5
5,911,182 A * 6/1999 Uyama et al. ..... 112/102.5
5,943,972 A * 8/1999 Hirata ..... 112/102.5
6,167,822 B1 * 1/2001 Miyasako et al. ..... 112/102.5
6,820,565 B1 11/2004 Kawaguchi et al.
7,702,415 B2 * 4/2010 Roos ..... 700/138
7,854,207 B2 * 12/2010 Kuki et al. ..... 112/102.5
2010/0242817 A1 9/2010 Tokura

FOREIGN PATENT DOCUMENTS

JP A-2004-254987 9/2004
JP A-2010-246885 11/2010

* cited by examiner

*Primary Examiner* — Nathan Durham
(74) *Attorney, Agent, or Firm* — Oliff and Berridge, PLC

(57) ABSTRACT

A sewing machine includes an image capturing portion configured to capture an image of a sewing object, a setting acquisition portion configured to acquire individual settings relating to a layout relationship between two patterns, a first image data acquisition portion configured to acquire first image data, a second image data acquiring portion configured to acquire second image data in a case where there is a non-continuous adjacent pattern in a position adjacent to a reference pattern, a third image data acquisition portion configured to acquire third image data, a fourth image data acquisition portion configured to acquire fourth image data in a case where the continuous pattern is also a non-continuous adjacent pattern, a first layout determination portion configured to determine a first layout, a second layout determination portion configured to determine a second layout, and a sewing data correction portion configured to correct sewing data.

3 Claims, 21 Drawing Sheets

SEWING MACHINE

CROSS-REFERENCE TO RELATED APPLICATION

This application claims priority to Japanese Patent Application No. 2011-213731, filed Sep. 29, 2011, the content of which is hereby incorporated herein by reference.

BACKGROUND

The present disclosure relates to a sewing machine that performs positioning between a plurality of patterns using an image of a marker arranged on a sewing object held by an embroidery frame.

Generally, a sewing machine capable of embroidery sewing performs embroidery sewing in a sewing area, using an embroidery frame that holds a sewing object (a work cloth, for example). The sewing area is set inside the embroidery frame in accordance with a type of the embroidery frame. For example, a sewing machine is known in which an embroidery pattern that is larger than the sewing area is divided into a plurality of patterns that are smaller than the sewing area, and sewing data corresponding to the plurality of patterns is stored. This sewing machine may sequentially sew the plurality of divided patterns in accordance with the sewing data. In this way, the sewing machine may sew the embroidery pattern that is larger than the sewing area. Every time one of the plurality of divided patterns is sewn, a user may rearrange a work cloth with respect to the embroidery frame. The sewing machine, which includes an image capturing device, may capture images of a marker arranged on a surface of the work cloth, before and after the rearrangement of the work cloth. Then, based on the images of the marker, the sewing machine may perform positioning of the plurality of patterns that are continuously sewn.

SUMMARY

In the above-described sewing machine, for example, when a first pattern to a fourth pattern are sequentially and continuously sewn, it is possible to perform accurate positioning between the first pattern and the second pattern, between the second pattern and the third pattern, and between the third pattern and the fourth pattern. However, by the time the fourth pattern is sewn, slight errors may have accumulated or sewing shrinkage or twisting of the work cloth may occur. Therefore, a case may arise in which positions of the first pattern and the fourth pattern, which are not continuous in the sewing order, cannot be accurately aligned. As a result, there is a possibility that appearance deteriorates, such as a gap being generated between the first pattern and the fourth pattern, which should be in contact with each other.

Embodiments of the broad principles derived herein provide a sewing machine that can accurately perform positioning between patterns that are not continuous in a sewing order in a case where a plurality of patterns are sewn, while changing a holding position of a sewing object by an embroidery frame.

Embodiments provide a sewing machine capable of embroidery sewing. The sewing machine includes an image capturing portion, a setting acquisition portion, a first image data acquisition portion, a second image data acquiring portion, a third image data acquisition portion, a fourth image data acquisition portion, a first layout determination portion, a second layout determination portion, and a sewing data correction portion. The image capturing portion is configured to capture an image of a sewing object held by an embroidery frame. The setting acquisition portion is configured to acquire individual settings relating to a layout relationship between two patterns that are to be continuously sewn, with respect to at least three patterns that are sequentially sewn in adjacent positions in accordance with a sewing order in states in which holding positions of the sewing object by the embroidery frame are each different. The first image data acquisition portion is configured to acquire first image data every time each of the at least three patterns is sewn in accordance with the sewing order. The first image data is image data of an image that includes a marker arranged in a first position and that is captured by the image capturing portion in a holding position corresponding to each of the at least three patterns. The first position is a position, on the sewing object, in a vicinity of an adjacent section with a continuous pattern. The continuous pattern is another one of the at least three patterns that is next in the sewing order. The second image data acquiring portion is configured to acquire second image data in a case where there is a non-continuous adjacent pattern in a position adjacent to a reference pattern. The reference pattern is one of the at least there patterns. The second image data is image data of an image that includes a marker arranged in a second position and that is captured by the image capturing portion in a holding position corresponding to the reference pattern. The non-continuous adjacent pattern is another one of the at least three patterns that is sewn at least two patterns later than the reference pattern in the sewing order. The second position is a position, on the sewing object, in a vicinity of an adjacent section with the non-continuous adjacent pattern. The third image data acquisition portion is configured to acquire third image data after the first image data corresponding to each of the at least three patterns is acquired in accordance with the sewing order. The third image data is image data of an image that includes the marker arranged in the first position and that is captured by the image capturing portion in a holding position corresponding to the continuous pattern. The fourth image data acquisition portion is configured to acquire fourth image data in a case where the continuous pattern corresponding to the third image data that has been acquired is also a non-continuous adjacent pattern of a reference pattern. The fourth image data is image data of an image that includes the marker arranged in the second position and that is captured by the image capturing portion in a holding position corresponding to the continuous pattern that is also the non-continuous adjacent pattern. With respect to the continuous pattern of each of the at least three patterns, the first layout determination portion is configured to determine a first layout based on sewing data of the continuous pattern and of an immediately preceding pattern in the sewing order, the settings, the first image data, and the third image data. The first layout is a layout of the continuous pattern on the sewing object in the holding position corresponding to the continuous pattern. With respect to the continuous pattern that is also the non-continuous adjacent pattern, the second layout determination portion is configured to determine a second layout based on sewing data of the non-continuous adjacent pattern and of the reference pattern, the settings, the second image data, and the fourth image data. The second layout is a layout of the continuous pattern that is also the non-continuous adjacent pattern on the sewing object in the holding position corresponding to the continuous pattern. The sewing data correction portion is configured to correct sewing data of the continuous pattern that is also the non-continuous adjacent pattern, based on the first layout and the second layout that have been determined with respect to the continuous pattern that is also the non-continuous adjacent pattern, such that the non-continuous adjacent pattern is adjacent to the reference pattern.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. First, a configuration of a multi-needle sewing machine (hereinafter referred to as a "sewing machine") 1 according to the present embodiment will be explained with reference to FIGS. 1 to 3. In the explanation that follows, in FIG. 1, the upper side, the lower side, the lower left side, the upper right side, the upper left side, and the lower right side of the page respectively correspond to the upper side, the lower side, the front side, the rear side, the left side, and the right side of the sewing machine 1.

Figure 1:
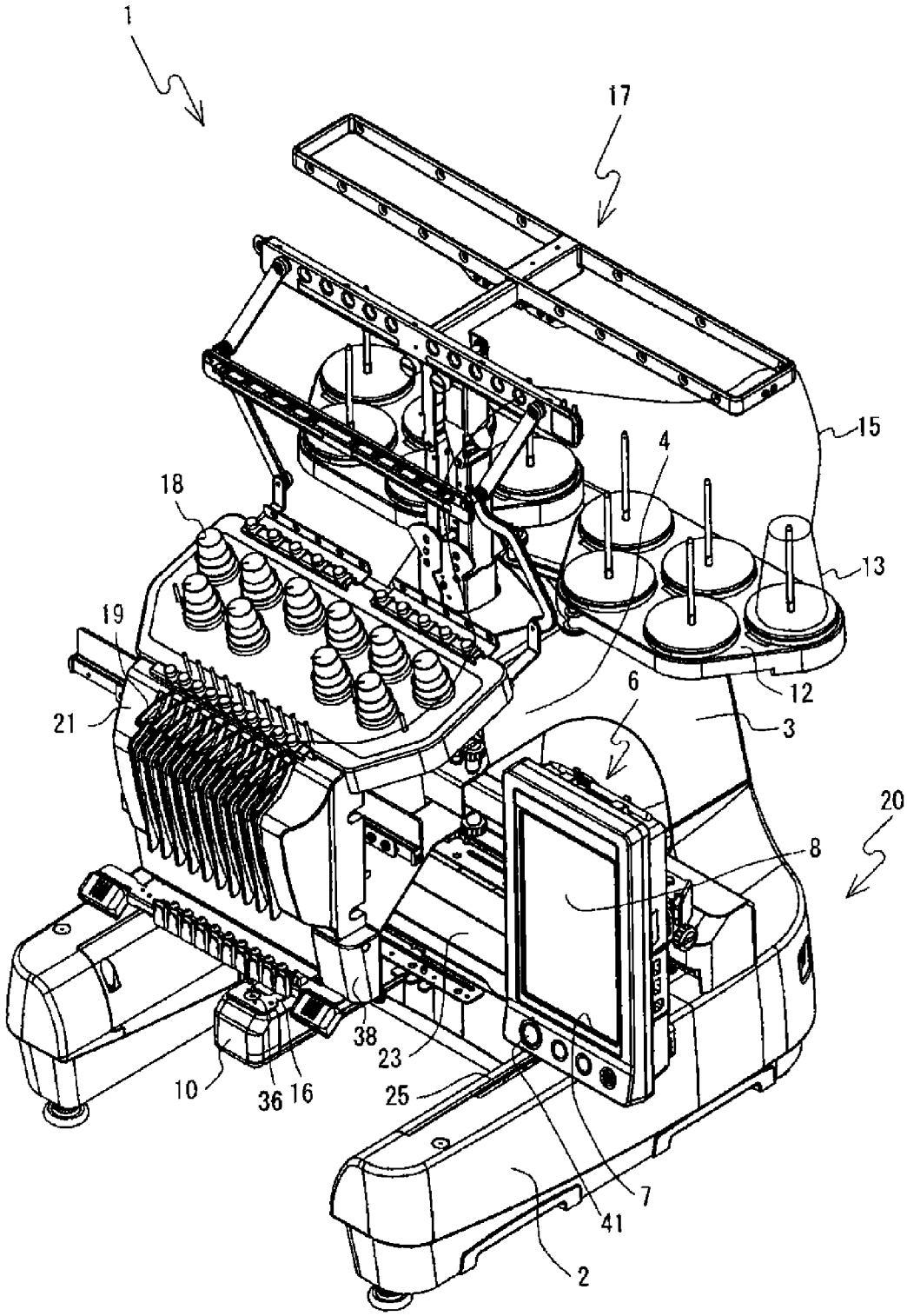
FIG. 1 is a perspective view of a multi-needle sewing machine.

As shown in FIG. 1, a body 20 of the sewing machine 1 includes a support portion 2, a pillar 3, and an arm 4. The support portion 2 is formed in an inverted U shape in a plan view and supports the entire sewing machine 1. A left-right pair of guide slots 25 that extend in the front-rear direction are provided in the top face of the support portion 2. The pillar 3 extends upward from the rear edge of the support portion 2. The arm 4 extends toward the front from the upper end of the pillar 3. A needle bar case 21 is mounted on the front end of the arm 4 such that the needle bar case 21 can be moved in the left-right direction. Ten needle bars 31 (refer to FIG. 3) that extend in the up-down direction are disposed at equal intervals in the left-right direction in the interior of the needle bar case 21. Among the ten needle bars 31, one of the needle bars 31 that is in a sewing position may be slid in the up-down direction by a needle bar drive mechanism 32 (refer to FIG. 3). The needle bar drive mechanism 32 is provided in the interior of the needle bar case 21. Needles 35 (refer to FIG. 3) may be attached to the lower ends of the needle bars 31.

A cover 38 is provided on a lower portion of a right side surface of the needle bar case 21. An image sensor holding mechanism (not shown in the drawings) is attached to the inner side of the cover 38. The image sensor holding mechanism is provided with an image sensor 50 (refer to FIG. 3). The image sensor 50 is a known complementary metal oxide semiconductor (CMOS) image sensor. A lens (not shown in the drawings) of the image sensor 50 is directed downward in the sewing machine 1.

An operation portion 6 is provided to the right of the central portion of the arm 4 in the front-rear direction. The operation portion 6 includes a liquid crystal display (LCD) 7, a touch panel 8, and a start/stop switch 41. Various types of information, such as an operation screen that is used when a user inputs a command, may be displayed on the LCD 7. The touch panel 8 is used for accepting a command from the user. The user may select and set various types of conditions, such as a sewing pattern and sewing conditions, by using the user's finger or a stylus pen to press a location on the touch panel 8 that corresponds to a position of an input key or the like that is displayed on the LCD 7. The pressing of a location on the touch panel 8 using the user's finger or a stylus pen is hereinafter referred to as a "panel operation". The start/stop switch 41 is used to issue a command to start and stop the sewing.

A cylindrical cylinder bed 10 that extends toward the front from the lower end of the pillar 3 is provided below the arm 4. A shuttle (not shown in the drawings) is provided in the interior of the front end portion of the cylinder bed 10. The shuttle may contain a bobbin (not shown in the drawings), around which a lower thread (not shown in the drawings) is wound. A shuttle drive mechanism (not shown in the drawings) is provided in the interior of the cylinder bed 10. The shuttle drive mechanism (not shown in the drawings) may rotationally drive the shuttle. A needle plate 16, which is rectangular in a plan view, is provided on the top face of the cylinder bed 10. A needle hole 36, which the needle 35 (refer to FIG. 2) may pass through, is provided in the needle plate 16.

A left-right pair of spool stands 12 are provided on the rear side of the top face of the arm 4. Ten of the thread spools 13, the same number as the number of the needle bars 31, may be disposed on the pair of the spool stands 12. Upper threads 15 may be supplied from the thread spools 13 that are disposed on the spool stands 12. The upper threads 15 may be supplied, through thread guides 17, tensioners 18, thread take-up levers 19, and the like, to needle eyes (not shown in the drawings) of the individual needles 35 that are attached to the lower ends of the needle bars 31.

A Y carriage 23 of an embroidery frame moving mechanism 11 (refer to FIG. 2) is provided below the arm 4. The embroidery frame moving mechanism 11 may support an embroidery frame 84 (refer to FIG. 2) such that the embroidery frame 84 can be attached to and detached from the embroidery fame moving mechanism 11. The embroidery frame 84 may hold the sewing object 39 (a work cloth etc.). Various kinds of embroidery frames may be used as the embroidery frame 84. The embroidery frame moving mechanism 11 may move the embroidery frame 84 in the front-rear and left-right directions using an X axis motor 132 (refer to FIG. 3) and a Y axis motor 134 (refer to FIG. 3) as drive sources.

The embroidery frame 84 and the embroidery frame moving mechanism 11 will be explained with reference to FIG. 2. The embroidery frame 84 includes an outer frame 81, an inner frame 82, and a left-right pair of coupling portions 89. The embroidery frame 84 may hold the sewing object 39 clamped between the outer frame 81 and the inner frame 82. The user can change the holding position of the sewing object 39 by the embroidery frame 84, by changing sections of the sewing object 39 clamped by the outer frame 81 and the inner frame 82. The coupling portions 89 are plate members having a rectangular shape in a plan view, and their central portions are cut out in a rectangular shape. One of the coupling portions 89 is fixed to a right portion of the inner frame 82 by screws 95. The other of the coupling portions 89 is fixed to a left portion of the inner frame 82 by screws 94. In addition to the embroidery frame 84 exemplified in FIG. 2, a plurality of types of the embroidery frame 84 that are different in size and shape can each be mounted on the sewing machine 1. The embroidery frame 84 exemplified in FIG. 2 has a width in the left-right direction (i.e., a distance between the left and right coupling portions 89) that is largest among the embroidery frames 84 that can be used for the sewing machine 1.

For example, a sewing area 86 is automatically set on the inner side of the inner frame 82 by a CPU 61 (refer to FIG. 3) of the sewing machine 1 in accordance with a type of the embroidery frame 84, based on an output signal of a known detector (not shown in the drawings). For example, Japanese Laid-Open Patent Publication No. 2004-254987 discloses a detector, the relevant portions of which are incorporated by reference. Alternatively, the user may select the embroidery frame 84 to be used by a panel operation, and the sewing area 86 may be set in accordance with the selected embroidery frame 84.

The embroidery frame moving mechanism 11 includes a holder 24, an X carriage 22, an X axis drive mechanism (not shown in the drawings), the Y carriage 23, and a Y axis drive mechanism (not shown in the drawings). The holder 24 may support the embroidery frame 84 such that the embroidery frame 84 can be attached to and detached from the holder 24. The holder 24 includes an attaching portion 91, a right arm portion 92, and a left arm portion 93. The attaching portion 91 is a plate member that is rectangular in a plan view, with its long sides running in the left-right direction. The right arm portion 92 is a plate member that extends in the front-rear direction, and is secured to the right end of the attaching portion 91. The left arm portion 93 is a plate member that extends in the front-rear direction, and is attached to the left portion of the attaching portion 91. The left arm portion 93 is secured such that the position of the left arm portion 93 can be adjusted in the left-right direction in relation to the attaching portion 91. The right arm portion 92 may be engaged with one of the coupling portions 89 of the embroidery frame 84. The left arm portion 93 may be engaged with the other of the coupling portions 89.

The X carriage 22 is a plate-shaped member that extends in the left-right direction, and a portion of the X carriage 22 projects forward from the front face of the Y carriage 23. The attaching portion 91 of the holder 24 may be attached to the X carriage 22. The X axis drive mechanism (not shown in the drawings) includes a linear movement mechanism (not shown in the drawings). The linear movement mechanism includes a timing pulley (not shown in the drawings) and a timing belt (not shown in the drawings). Using the X axis motor 132 as a drive source, the linear movement mechanism may move the X carriage 22 in the left-right direction (the X axis direction).

The Y carriage 23 has a box shape that extends in the left-right direction. The Y carriage 23 supports the X carriage 22 such that the X carriage 22 can be moved in the left-right direction. The Y axis drive mechanism (not shown in the drawings) includes a left-right pair of moving bodies (not shown in the drawings) and a linear movement mechanism (not shown in the drawings). The moving bodies are respectively coupled to the undersides of the left and right ends of Y carriage 23. The moving bodies pass vertically through the guide slots 25 (refer to FIG. 1). The linear movement mechanism includes a timing pulley (not shown in the drawings) and a timing belt (not shown in the drawings). Using the Y axis motor 134 as a drive source, the linear movement mechanism may move the moving bodies through the guide slots 25 in the front-rear direction (the Y axis direction). Thus, the Y carriage 23, which is coupled to the moving bodies, and the X carriage 22, which is supported by the Y carriage 23, may be moved in the front-rear direction (in the Y-axis direction). In a state in which the embroidery frame 84 that holds the sewing object 39 is attached to the X carriage 22, the sewing object 39 is disposed between the a needle bar 31 and the needle plate 16 (refer to FIG. 1).

Figure 3:
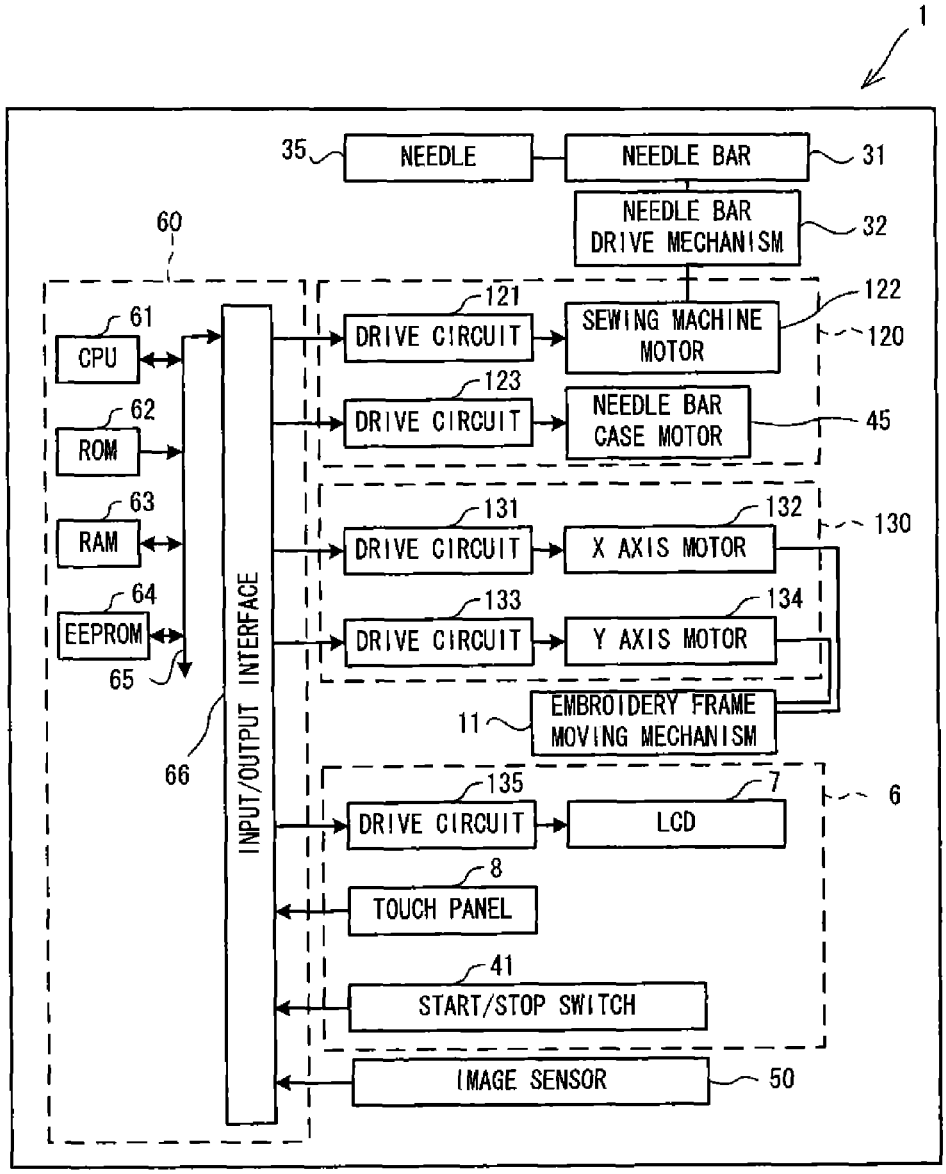
FIG. 3 is a block diagram showing an electrical configuration of the multi-needle sewing machine.

An electrical configuration of the sewing machine 1 will be explained with reference to FIG. 3. As shown in FIG. 3, the sewing machine 1 includes a needle drive portion 120, a sewing object drive portion 130, the operation portion 6, a control portion 60, and the image sensor 50.

The needle drive portion 120 includes a sewing machine motor 122, a drive circuit 121, a needle bar case motor 45, and a drive circuit 123. The sewing machine motor 122 may move one of the needle bars 31 reciprocally in the up-down direction by driving the needle bar drive mechanism 32. The drive circuit 121 may drive the sewing machine motor 122 in accordance with a control signal from the control portion 60. The needle bar case motor 45 may move the needle bar case 21 in the left-right direction. The drive circuit 123 may drive the needle bar case motor 45 in accordance with a control signal from the control portion 60.

The sewing object drive portion 130 includes the X axis motor 132, a drive circuit 131, the Y axis motor 134, and a drive circuit 133. The X axis motor 132 may move the embroidery frame 84 (refer to FIG. 2) in the left-right direction by driving the embroidery frame moving mechanism 11. The drive circuit 131 may drive the X axis motor 132 in accordance with a control signal from the control portion 60. The Y axis motor 134 may move the embroidery frame 84 in the front-rear direction by driving the embroidery frame moving mechanism 11. The drive circuit 133 may drive the Y axis motor 134 in accordance with a control signal from the control portion 60.

The operation portion 6 includes the touch panel 8, a drive circuit 135, the LCD 7, and the start/stop switch 41. The drive circuit 135 may drive the LCD 7 in accordance with a control signal from the control portion 60.

The control portion 60 includes a CPU 61, a ROM 62, a RAM 63, an EEPROM 64, and an input/output interface 66, all of which are connected to one another via a signal line 65. The needle drive portion 120, the sewing object drive portion 130, the operation portion 6, and the image sensor 50 are connected to the input/output interface 66.

The CPU 61 performs main control of the sewing machine 1. The CPU 61 may perform various types of computations and processing that are related to sewing, in accordance with various types of programs that are stored in a program storage area (not shown in the drawings) of the ROM 62. The ROM 62 includes a plurality of storage areas that include the program storage area and a pattern storage area, although not shown in the drawings. Various types of programs for operating the sewing machine 1, including a main program, are stored in the program storage area. The main program is a program for performing main processing, which will be described below. The sewing data for sewing a pattern (hereinafter also referred as to an "embroidery pattern") is stored in the pattern storage area. As necessary, the RAM 63 includes a storage area that stores computation results and the like from computational processing by the CPU 61. The EEPROM 64 stores various types of parameters for performing various types of processing by the sewing machine 1. The EEPROM 64 also stores the colors of the upper threads 15 that are to be supplied to the needle eyes (not shown in the drawings) of the needles 35 that are attached to the lower ends of the individual needle bars 31 in association with the individual needle bars 31. The sewing data may be stored in the EEPROM 64.

An operation of the sewing machine 1 that forms a stitch on the sewing object 39 that is held by the embroidery frame 84 will be explained with reference to FIGS. 1 to 3. The embroidery frame 84 that holds the sewing object 39 may be supported by the embroidery frame moving mechanism 11. One of the ten needle bars 31 may be selected by the moving of the needle bar case 21 to the left or the right. The embroidery frame 84 may be moved to a specified position by the embroidery frame moving mechanism 11. When a drive shaft (not shown in the drawings) is rotationally driven by the sewing machine motor 122, the needle bar drive mechanism 32 and a thread take-up lever drive mechanism (not shown in the drawings) are driven, such that the selected needle bar 31 and the corresponding thread take-up lever 19 are driven up and down. The shuttle drive mechanism is also driven by the rotation of the sewing machine motor 122, such that the shuttle is rotationally driven. Thus, the needle 35, the thread take-up lever 19, and the shuttle are driven in synchronization with one another, so that a stitch may be formed on the sewing object 39.

The sewing data according to the present embodiment will be explained with reference to FIG. 2. The sewing data according to the present embodiment include the coordinate data for an embroidery coordinate system 100 shown in FIG. 2. The embroidery coordinate system 100 is a coordinate system for the X axis motor 132 and the Y axis motor 134 that move the X carriage 22. The coordinate data for the embroidery coordinate system 100 describes the position and the angle of the embroidery pattern in relation to a reference (the X carriage 22, for example). The embroidery frame 84 that holds the sewing object 39 may be mounted on the X carriage 22. Therefore, the coordinate data for the embroidery coordinate system 100 describes the position and the angle of the embroidery pattern in relation to the sewing object 39 that is held by the embroidery frame 84. In the present embodiment, the embroidery coordinate system 100 corresponds to a world coordinate system in advance. The world coordinate system is a coordinate system that represents the whole of space. The world coordinate system is a coordinate system that is not influenced by the center of gravity etc. of a subject.

Figure 2:
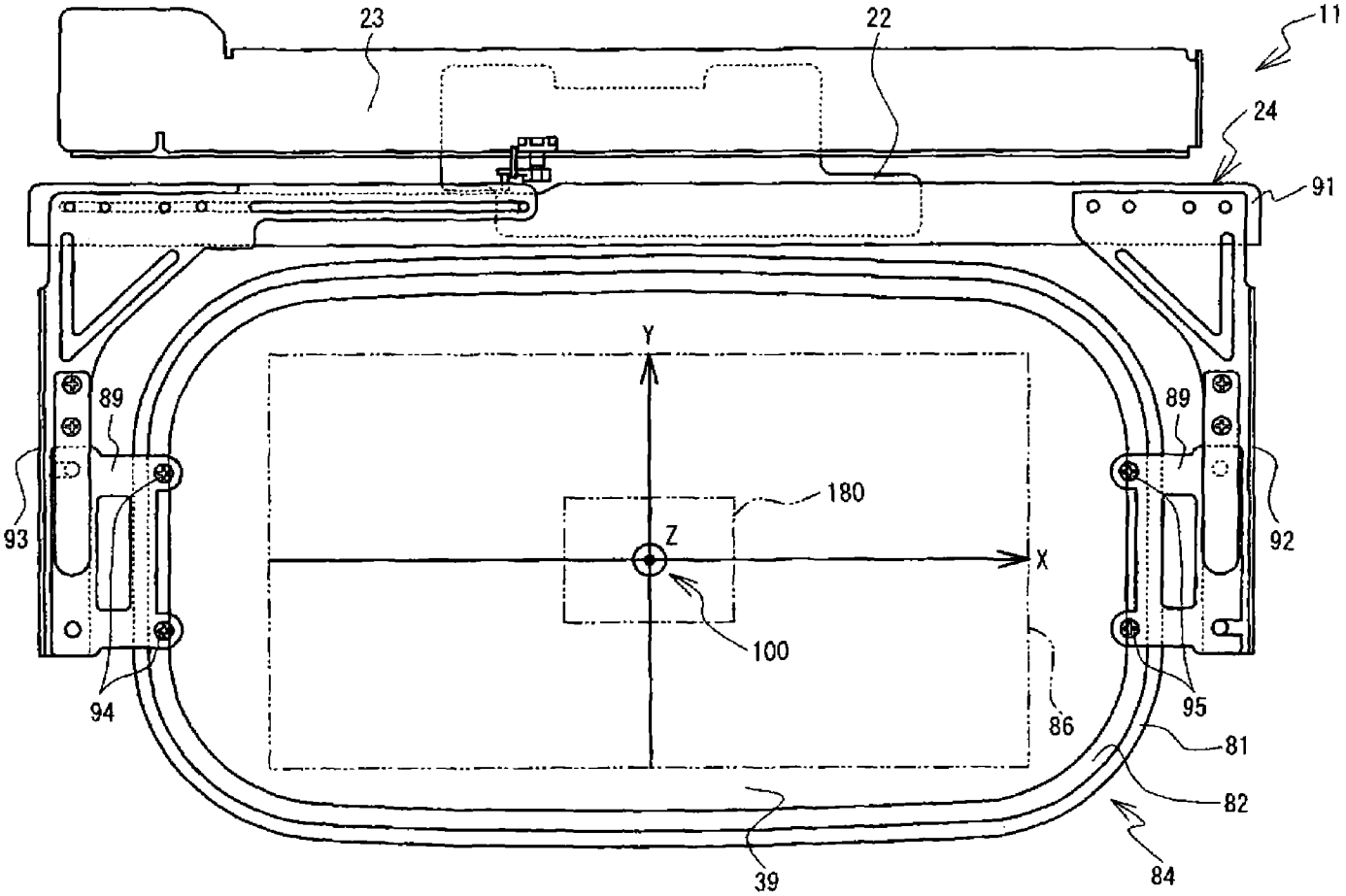
FIG. 2 is a plan view of an embroidery frame moving mechanism that holds an embroidery frame.

As shown in FIG. 2, in the embroidery coordinate system 100, the direction from the left to the right in the sewing machine 1 is the positive direction on the X axis, and the direction from the front to the rear in the sewing machine 1 is the positive direction on the Y axis. In the present embodiment, the initial position of the embroidery frame 84 is defined as being at the origin point (X, Y, Z)=(0, 0, 0) of the embroidery coordinate system 100. When the embroidery frame 84 is in the initial position, the center point of the sewing area 86 that corresponds to the embroidery frame 84 is aligned with a needle drop point. The needle drop point is the point where the needle 35 (refer to FIG. 3) that is positioned directly above the needle hole 36 (refer to FIG. 1) pierces the sewing object 39 when the needle bar 31 is moved downward from a state of being above the sewing object 39. The embroidery frame moving mechanism 11 according to the present embodiment does not move the embroidery frame 84 in the Z axis direction (the up-down direction in the sewing machine 1). Therefore, as long as the thickness of the sewing object 39 can be ignored, the upper surface of the sewing object 39 is defined as having a Z axis coordinate of zero.

The coordinate data in the sewing data stored in the ROM 62 specifies an initial position for the embroidery pattern. The initial position for the embroidery pattern is set such that the center point of the embroidery pattern coincides with the origin point of the embroidery coordinate system 100, that is, the center point of the sewing area 86. In a case where the position of the embroidery pattern has changed in relation to the sewing object 39, the coordinate data in the sewing data is corrected as necessary. In the present embodiment, the position of the embroidery pattern in relation to the sewing object 39 is set in accordance with the main processing that is described below. In the explanation that follows, the data that is expressed in the embroidery coordinate system 100 is used to set the position of (the center point of) the embroidery pattern and the angle of the embroidery pattern in relation to the sewing object 39 that is held by the embroidery frame 84.

An image capture area of the image sensor 50 (refer to FIG. 3) will be explained with reference to FIG. 2. In a case where the image sensor 50 is positioned at the image capture position, the image capture area of the image sensor 50 in the XY plane of the embroidery coordinate system 100 is a rectangular area with its center at a point that is directly below the center of the lens of the image sensor 50. The length of the rectangular area in the left-right direction is approximately 80 millimeters, and the length of the rectangular area in the front-rear direction is approximately 60 millimeters. The image capture position according to the present embodiment is a position at which the center of the lens of the image sensor 50 is disposed directly above the needle hole 36. As shown in FIG. 2, when the image sensor 50 is disposed in the image capture position and the embroidery frame 84 is disposed in the initial position, an image capture area 180 is a rectangular area centered on the origin of the embroidery coordinate system 100.

Figure 4:
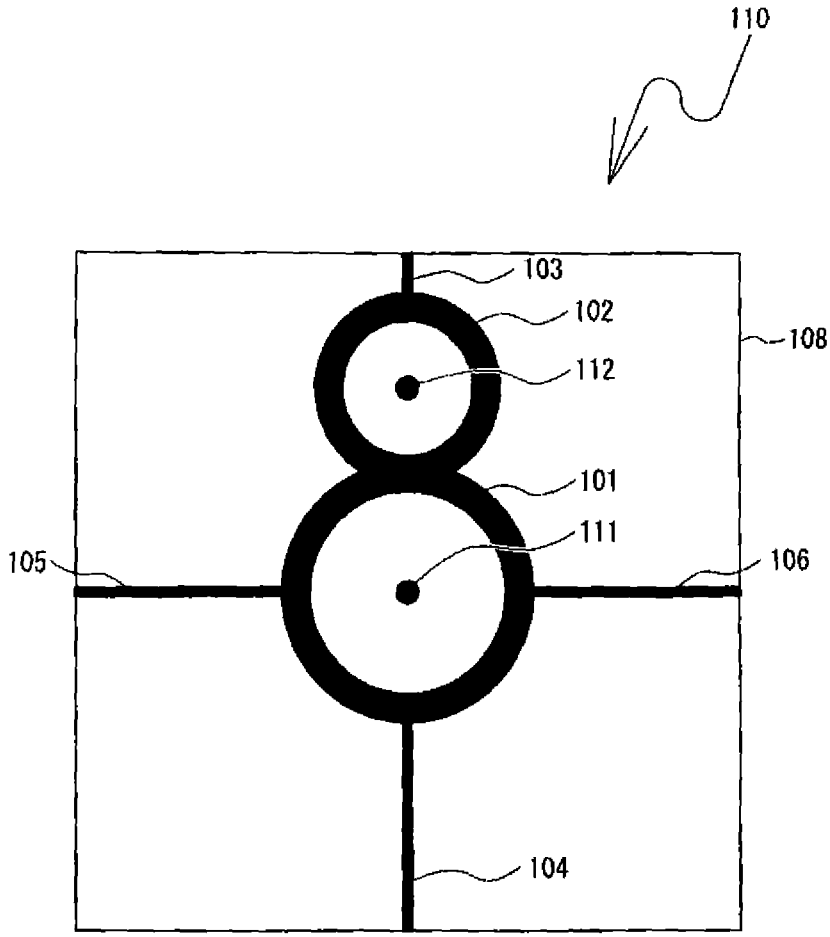
FIG. 4 is a plan view of a marker.

A marker 110 will be explained with reference to FIG. 4. The explanation will be made assuming that the upper side, the lower side, the left side, and the right side of FIG. 4 respectively correspond to the upper side, the lower side, the left side, and the right side of the pattern drawn in the marker 110. The marker 110 is made such that the pattern is drawn on an upper surface of a white base sheet 108 having a thin plate shape. The base sheet 108 may have a square shape in which the length is approximately 2.5 centimeters and the width is approximately 2.5 centimeters, for example. A first circle 101, a second circle 102, a first center point 111, and a second center point 112 are drawn on the upper surface of the base sheet 108. The second circle 102 is arranged above the first circle 101. The diameter of the second circle 102 is smaller than the diameter of the first circle 101. The first center point 111 is the center of the first circle 101. The second center point 112 is the center of the second circle 102. Further, line segments 103 to 106 are drawn on the upper surface of the base sheet 108. The line segment 103 and the line segment 104 overlap with a virtual straight line (not shown in the drawings) that passes through the first center point 111 and the second center point 112. The line segment 105 and the line segment 106 overlap with a virtual straight line (not shown in the drawings) that passes through the first center point 111 of the first circle 101 and that is orthogonal to the line segment 103. The line segments 103 to 106 are respectively drawn to the outer edges of the base sheet 108.

A transparent adhesive is applied to a back surface of the base sheet 108. It is therefore possible to affix the base sheet 108 onto the sewing object 39. Normally, the base sheet 108 is adhered to a release paper (not shown in the drawings). The user may peel the base sheet 108 from the release paper and uses the base sheet 108.

The main processing that is performed by the sewing machine 1 will be explained with reference to FIGS. 5 to 20. A plurality of patterns may be sequentially sewn in adjacent positions while the holding position of the sewing object 39 by the embroidery frame 84 (refer to FIG. 2) is changed. In this case, in the main processing according to the present embodiment, positioning between two continuous patterns is accurately performed using images of the marker 110 affixed onto the sewing object 39. Particularly, among at least three patterns that are sequentially sewn in adjacent positions, in a position adjacent to one of the patterns, there may be another one of the patterns that is sewn two or more patterns later than that pattern in the sewing order. In this case, in the main processing according to the present embodiment, positioning between these two patterns that are not continuously sewn and that are adjacent to each other is also performed using images of the marker 110 affixed onto the sewing object 39.

In the explanation below, in a case where there are a plurality of patterns that are continuously sewn in a state in which holding positions of the sewing object 39 by the embroidery frame 84 are different, a pattern that is sewn next in a position adjacent to one of the patterns that has already been sewn is also referred to as a "continuous pattern of a preceding pattern". Among at least three patterns that are sequentially sewn in adjacent positions, when one of the patterns is taken as a reference (a reference pattern), another one of the patterns that is sewn in a position adjacent to the reference pattern and that is sewn two or more patterns later than the reference pattern in the sewing order is also referred to as a "non-continuous adjacent pattern". The one of the patterns that is taken as the reference for the non-continuous adjacent pattern is also referred to as a "reference pattern". The processing will be explained taking a case as an example in which four patterns 151, 152, 153, and 154, which are obtained by dividing a pattern 150 shown in FIG. 6 into four, are sequentially sewn respectively in different holding positions and thus the single pattern 150 is formed as a whole. In this example, the pattern 152 is the continuous pattern of the pattern 151. The pattern 153 is the continuous pattern of the pattern 152. The pattern 154 is the continuous pattern of the pattern 153, and is also the non-continuous adjacent pattern of the pattern 151 when the pattern 151 is taken as a reference pattern.

Figure 5:
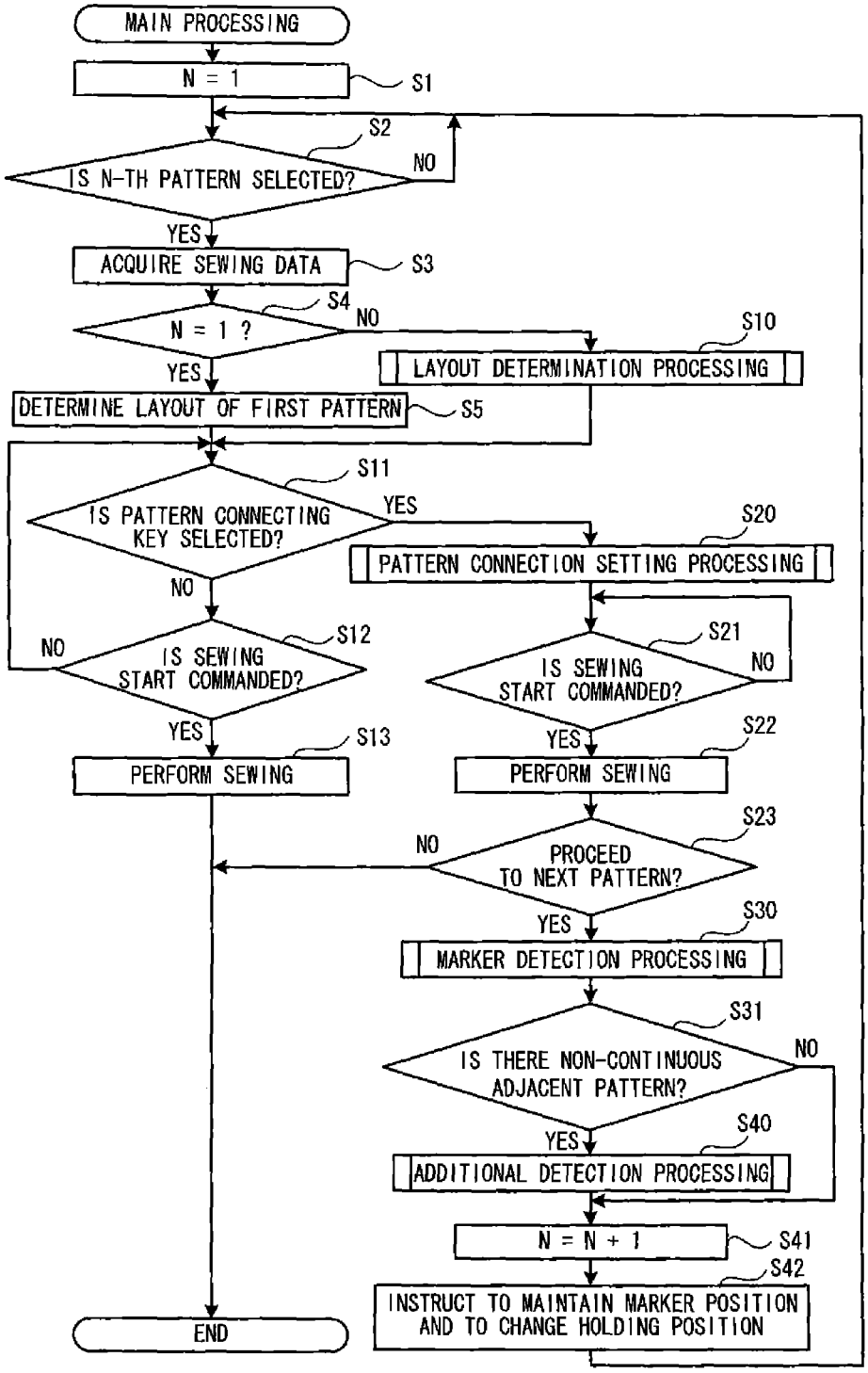
FIG. 5 is a flowchart of main processing.

The main processing shown in FIG. 5 is performed when the a command is input to start the main processing. The command to start the main processing may be input by a panel operation, for example. The program to perform the main processing is stored in the ROM 62 (refer to FIG. 3) and is performed by the CPU 61. In the explanation below, an image that is represented by image data generated by the image sensor 50 is referred to as a captured image. Various screens and messages shown below as examples are displayed on the LCD 7 when a control signal is output to the drive circuit 135. In the various screens that are shown as examples, the left-right direction and the up-down direction of each of the drawings are respectively referred to as the left-right direction and the up-down direction of each of the screens.

Figure 7:
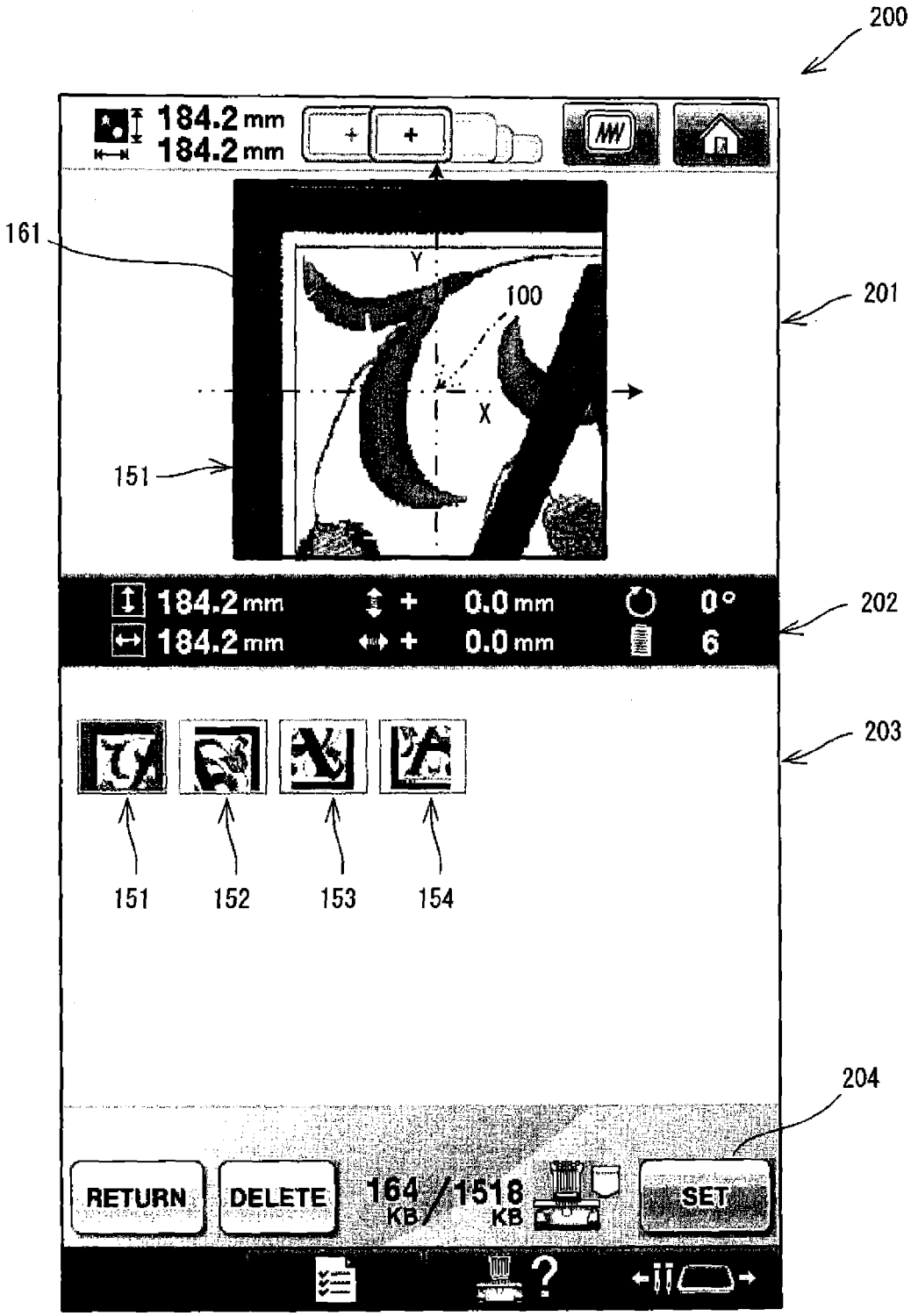
FIG. 7 is an explanatory diagram of a selection screen.

As shown in FIG. 5, in the main processing, first, a variable N is set to 1 and the set variable N is stored in the RAM 63 (step S1). The variable N is a variable for counting the number of the patterns selected by the user. The variable N corresponds to a sewing order of the selected pattern. The CPU 61 stands by as long as an N-th pattern is not selected (no at step S2). At step S2, first, a selection screen 200 exemplified in FIG. 7 is displayed on the LCD 7. The selection screen 200 includes, for example, a pattern display column 201, a pattern information column 202, a pattern selection column 203, and a SET key 204.

The center point of the pattern display column 201 corresponds to the origin of the embroidery coordinate system 100. The left-right direction and the up-down direction of the pattern display column 201 respectively correspond to the X-axis direction and the Y-axis direction of the embroidery coordinate system 100. A currently selected pattern (the pattern 151 in the example shown in FIG. 7) is displayed in the pattern display column 201 together with a graphic that represents an area in which the currently selected pattern is sewn. In the present embodiment, the graphic that represents the area in which a pattern is sewn is shown by a rectangle 161. When the pattern is selected, the pattern is displayed in an initial layout. More specifically, the pattern is displayed such that the center point of the pattern is located at the center point of the pattern display column 201. At this time, the rectangle 161 includes sides that are parallel in the left-right direction of the pattern display column 201, and sides that are parallel in the up-down direction of the pattern display column 201. For example, a size of the rectangle 161, an amount of movement and a rotation angle with respect to the initial layout of the pattern, and the number of embroidery thread colors that are necessary are displayed in the pattern information column 202.

Figure 6:
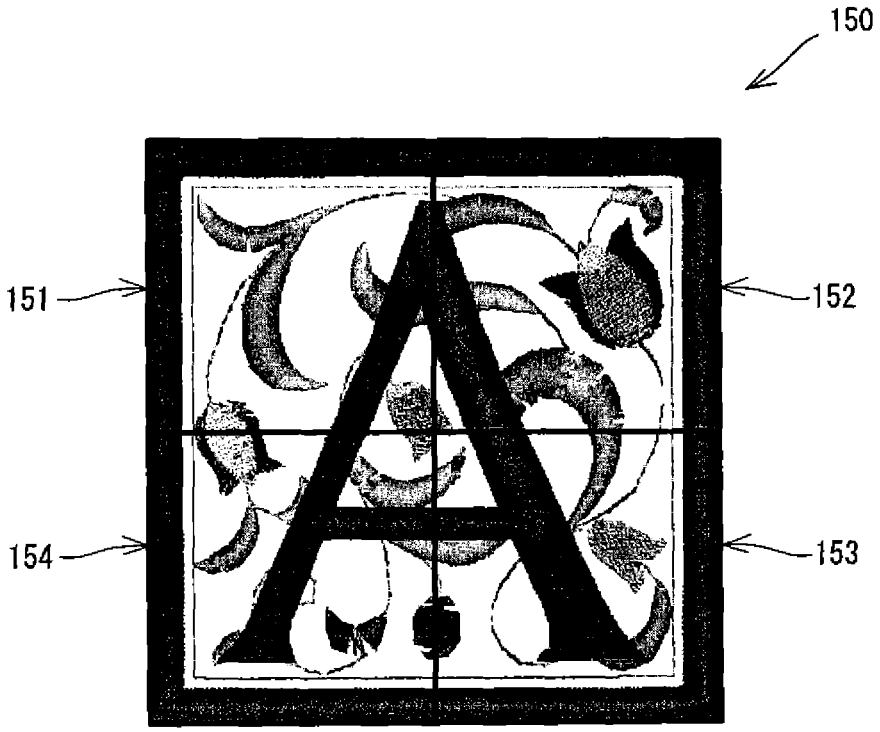
FIG. 6 is a diagram showing a pattern and a plurality of patterns that form the pattern.

A plurality of patterns that can be sewn by the sewing machine 1 are displayed in the pattern selection column 203 based on the sewing data stored in the ROM 62 or the EEPROM 64. In the example shown in FIG. 7, the patterns 151 to 154 that form the pattern 150 shown in FIG. 6 are displayed as the plurality of patterns that can be sewn by the sewing machine 1. The user may select a desired pattern (for example, the pattern 151) by a panel operation from among the plurality of patterns. After that, in a case where the SET key 204 is selected, it is determined that the N-th pattern is selected (YES at step S2). In this case, the sewing data corresponding to the selected N-th pattern is acquired from the ROM 62 or the EEPROM 64 and the acquired sewing data is stored in the RAM 63 (step S3).

Figure 8:
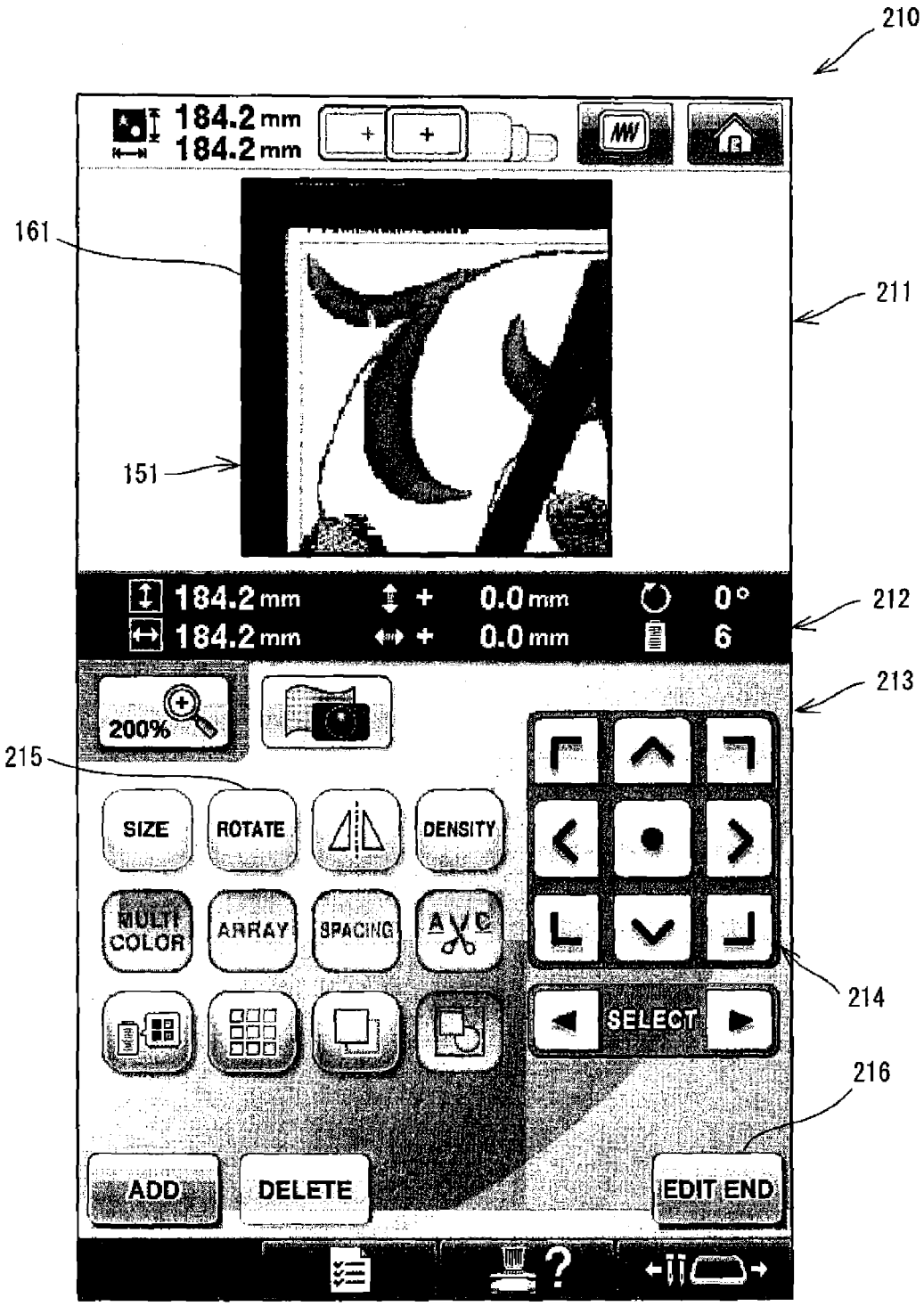
FIG. 8 is an explanatory diagram of an edit screen.

In the first processing, the variable N is 1 (YES at step S4). Therefore, next, the layout of the first pattern in the embroidery coordinate system 100 is determined (step S5). Specifically, the sewing data of the first pattern 151 acquired at step S3 may be corrected using a known method in accordance with editing content of the pattern commanded by the user. Thus, the layout of the first pattern with respect to the sewing object 39 in the holding position in which the first pattern is sewn is determined. At step S5, first, an edit screen 210 exemplified in FIG. 8 is displayed. The edit screen 210 includes, for example, a pattern display column 211, a pattern information column 212, and a pattern edit column 213. The pattern display column 211 is similar to the pattern display column 201.

The pattern edit column 213 includes various types of keys that are used to issue a command to edit the pattern, such as a group of movement keys 214 including eight direction keys, a rotation key 215, and the like. The user can issue a command to edit the pattern by selecting, by a panel operation, a key displayed in the pattern edit column 213. For example, the user can move the pattern by a desired amount of movement from the initial layout by performing a panel operation using one of the eight direction keys included in the group of movement keys 214. On a screen (not shown in the drawings) that is displayed when the rotation key 215 is selected, the user can rotate the pattern by a desired angle from the initial layout around the center point of the pattern. In addition to the above, the user can perform editing, such as changing a size of the pattern, reversing the pattern, and the like, via the edit screen 210. When the movement or rotation of the pattern is commanded, the commanded amount of movement or rotation angle is displayed in the pattern information column 212. The pattern that reflects the editing content is displayed in the pattern display column 211. In the example shown in FIG. 8, editing of the pattern 151 is not performed.

After the pattern editing, when the user selects an EDIT END key 216 located in the lower right of the pattern edit column 213, the editing content commanded so far is ascertained. Then, the sewing data of the pattern edited by the known method is corrected and the corrected sewing data is stored in the RAM 63. Further, a screen (not shown in the drawings) that includes the edited pattern, a sewing start key, and a pattern connecting key is displayed on the LCD 7. The sewing start key is used for issuing a command to start the sewing of the pattern. The pattern connecting key is used for issuing a command to perform pattern connection setting processing in order to sew the next pattern to be connected. The pattern connection setting processing is necessary in a case where an (N+1)-th pattern is continuously sewn in a position adjacent to the N-th pattern selected at step S2 and in a case where the whole of the N-th pattern and the (N+1)-th pattern is sewn in an area that is larger than the sewing area 86.

The CPU 61 stands by as long as either one of the pattern connecting key and the sewing start key is not selected (NO at step S11, NO at step S12, step S11). The user may confirm the edited pattern displayed on the screen, and in a case where the user desires to continue sewing without any change, the user may select not the pattern connecting key but the sewing start key. Thus, a sewing start command may be input (NO at step S11, YES at step S12). In this case, sewing of the first pattern is performed (step S13). Specifically, a control signal is output to the drive circuits 131 and 133 in accordance with the sewing data of the first pattern that has been corrected as necessary at step S5, so that the embroidery frame 84 is moved. A control signal is output to the drive circuit 121, so that the drive shaft motor 122 is driven. As a result of this, a stitch of the first pattern 151 is formed on the sewing object 39 held by the embroidery frame 84. After that, the main processing shown in FIG. 5 ends.

Figure 9:
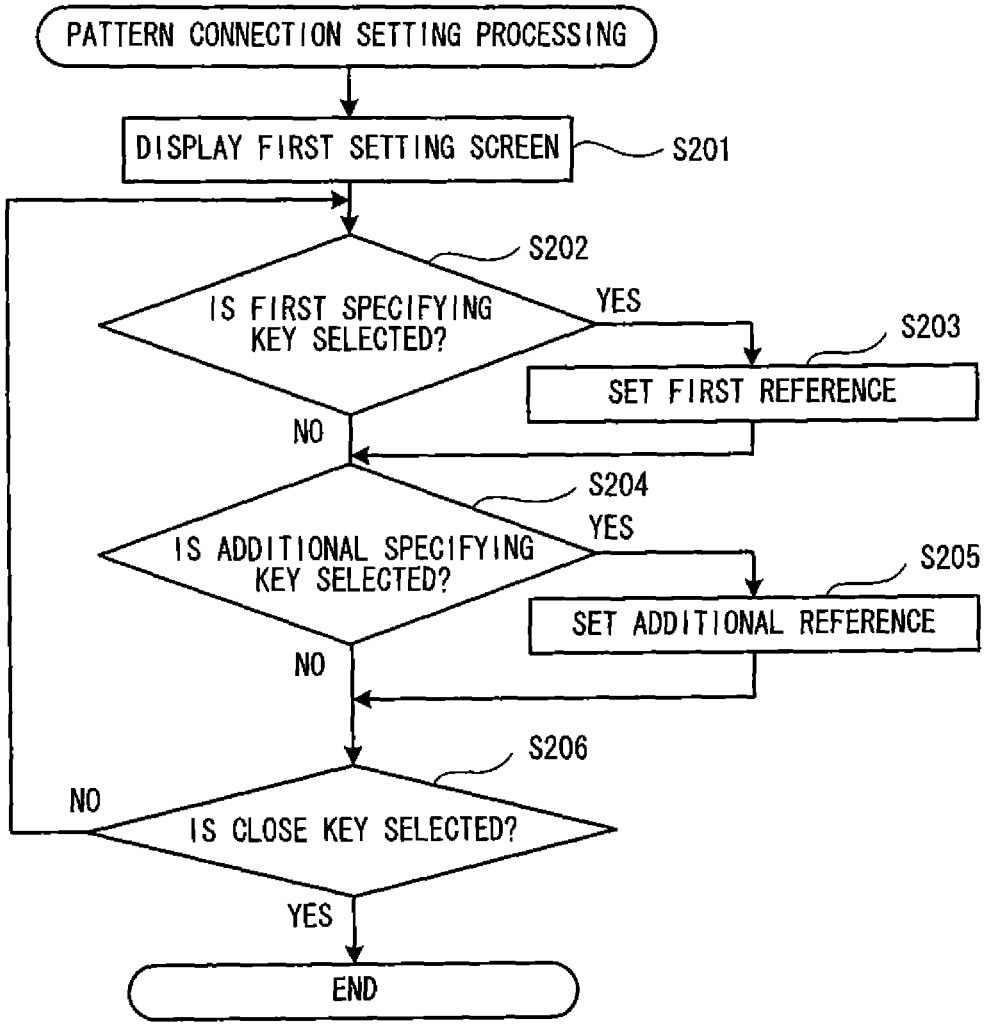
FIG. 9 is a flowchart of a pattern connection setting processing that is performed in the main processing.

On the other hand, in a case where the pattern connecting key is selected (YES at step S11), the pattern connection setting processing is performed (step S20, FIG. 9). In the pattern connection setting processing, a first reference and an additional reference are set. The first reference is a reference relating to the N-th pattern, and is used for determining a relative layout relationship between the N-th pattern, which is a processing target at this point in time, and the (N+1)-th pattern (the continuous pattern of the N-th pattern), which is to be sewn next in an adjacent position. In a case where there is a non-continuous adjacent pattern when the N-th pattern is taken as a reference pattern, the additional reference is a reference to identify an adjacent direction of the non-continuous adjacent pattern with respect to the N-th pattern.

Figure 10:
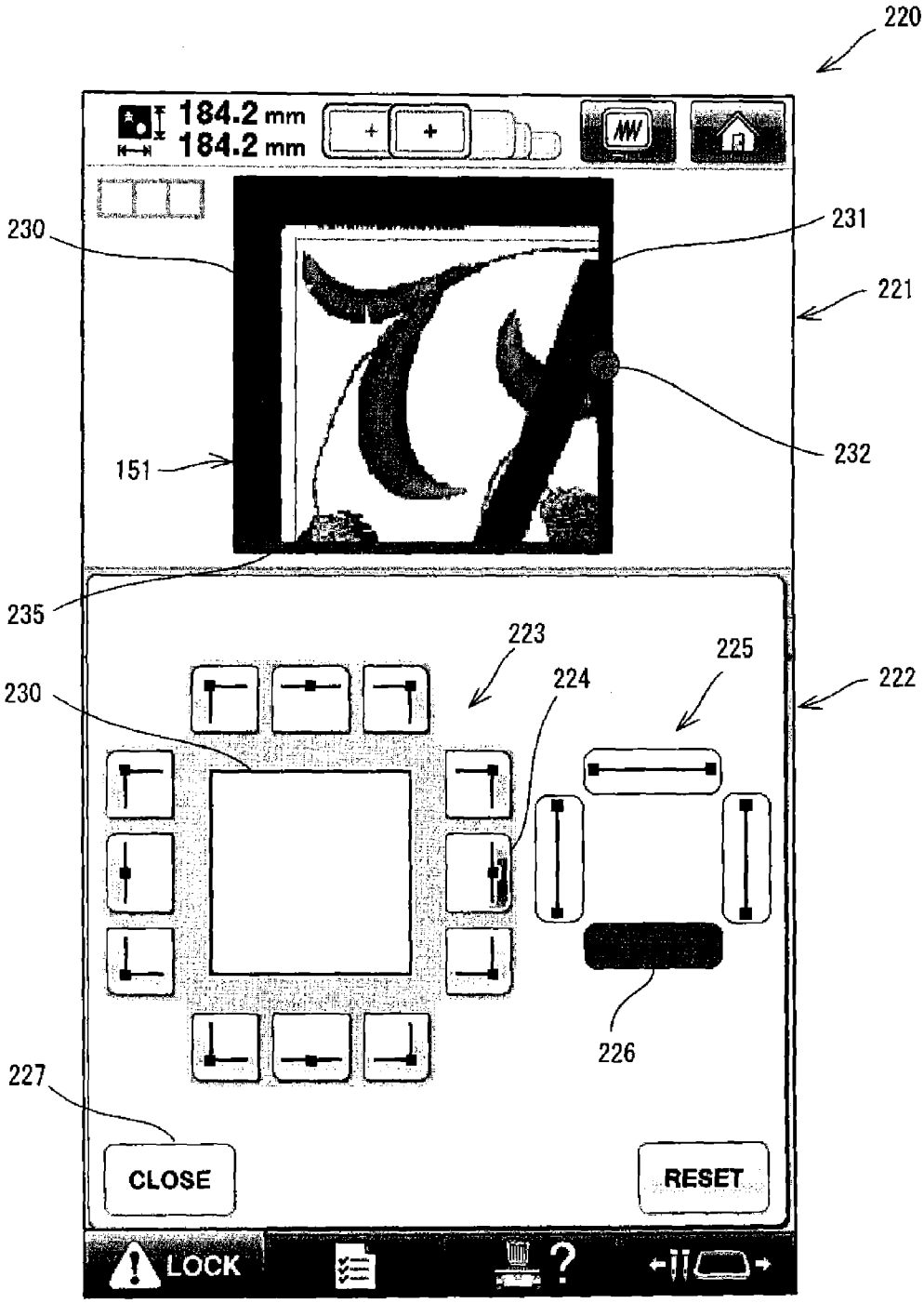
FIG. 10 is an explanatory diagram of a first setting screen.

As shown in FIG. 9, in the pattern connection setting processing, first, a first setting screen 220 exemplified in FIG. 10 is displayed on the LCD 7 (step S201). As shown in FIG. 10, the first setting screen 220 includes, for example, a pattern display column 221 and a command key column 222. In the pattern display column 221, the specified first reference is displayed overlapping with the processing target N-th pattern. In a case where the additional reference is also specified, the specified additional reference is also displayed overlapping with the processing target N-th pattern. The command key column 222 includes, for example, a group of first specifying keys 223, a group of additional specifying keys 225 and a CLOSE key 227.

The group of first specifying keys 223 includes twelve first specifying keys that are used for specifying the first reference. In the present embodiment, a line segment 231 and a point 232, which are included in a first graphic, are specified as the first reference. The first graphic is a graphic representing an area in which the N-th pattern is sewn. In the present embodiment, the first graphic is a smallest rectangle 230 in which the N-th pattern can be arranged. The smallest rectangle 230 is displayed in a central portion of the group of first specifying keys 223 arranged in a rectangular frame shape. The line segment 231 may be selected from among four sides of the smallest rectangle 230. The point 232 may be selected from among both end points of the line segment 231 and a midpoint of the line segment 231. In the present embodiment, twelve first specifying keys are provided in accordance with twelve combinations of the line segment 231 and the point 232. The combination of the line segment 231 and the point 232 that corresponds to the selected one of the first specifying keys is set as the first reference.

The group of additional specifying keys 225 includes four additional specifying keys that are used for specifying the additional reference. A line segment 235, which is included in the above-described first graphic, may be specified as the additional reference. In the present embodiment, the line segment 235 may be selected from among the four sides of the smallest rectangle 230. In the present embodiment, four additional specifying keys are provided corresponding to the four sides of the smallest rectangle 230. The line segment 235 that corresponds to the selected one of the additional keys is set as the additional reference. The CLOSE key 227 may be selected in a case where the first reference and the additional reference have been specified.

After the first setting screen 220 is displayed (step S201), it is determined whether one of the first specifying keys is selected from among the group of first specifying keys 223 (step S202). In a case where one of the first specifying keys is selected (YES at step S202), the first reference (the line segment 231 and the point 232) specified by the first specifying key is set and stored in the RAM 63 (step S203). The layout of the first reference (the line segment 231 and the point 232) in the smallest rectangle 230 that corresponds to the N-th pattern can be identified by coordinates of the embroidery coordinate system 100 based on the sewing data of that pattern. In a case where the pattern is edited at step S5 of the main processing shown in FIG. 5 and the sewing data is corrected, the layout of the first reference may be identified based on the corrected sewing data. The embroidery coordinate system 100 at this point in time is set with respect to the holding position that corresponds to the N-th pattern. The holding position corresponding to the N-th pattern is hereinafter referred to as an "N-th holding position". The identified layout of the line segment 231 and the point 232 in the N-th holding position is stored in the RAM 63.

Further, at step S203, the N-th pattern and the smallest rectangle 230 are displayed in the pattern display column 221, and the line segment 231 and the point 232 are added to the specified positions. FIG. 10 shows an example in which the first specifying key 224 is specified that corresponds to the right side and the midpoint of the right side of the smallest rectangle 230 that corresponds to the pattern 151. In the present embodiment, in order to easily visually check the first reference, the smallest rectangle 230, the line segment 231, and the point 232 are displayed in black, blue, and light blue, respectively. The layout of the smallest rectangle 230 is identified by the sewing data of the N-th pattern represented by the embroidery coordinate system 100.

In a case where none of the first specifying keys is selected (NO at step S202) or after the first reference is set as described above (step S203), it is determined whether one of the additional specifying keys is selected (step S204). In a case where the user desires to obtain the pattern 150 shown in FIG. 6 as a final sewing result, the patterns 151 to 154 may be sequentially sewn in the layout shown in FIG. 6. Therefore, in a case where the pattern 151 that is the first pattern is sewn, the user may recognize that not only the second pattern 152, which is sewn to the right of the pattern 151 to be continuous with the pattern 151, but also the pattern 154, which is thereafter sewn as the fourth pattern, is adjacent to the lower side of the pattern 151. In other words, the pattern 154 is the non-continuous adjacent pattern when the pattern 151 is taken as the reference pattern. In this case, in order to sew the pattern 154 such that the pattern 154 is also accurately aligned with the pattern 151, the user may use the additional specifying key to identify the adjacent direction of the pattern 154 with respect to the pattern 151.

In a case where one of the additional specifying keys is selected (YES at step S204), the additional reference specified by the additional specifying key is set and stored in the RAM 63 (step S205). The layout of the additional reference (the line segment 235) in the smallest rectangle 230 corresponding to the N-th pattern can be identified by coordinates of the embroidery coordinate system 100 based on the sewing data of that pattern, in a similar manner to the first reference. The identified layout of the line segment 235 is stored in the RAM 63. At step S205, in addition to the N-th pattern, the smallest rectangle 230, and the first reference, the line segment 235 is displayed in the specified position in the pattern display column 221. FIG. 10 shows an example in which an additional specifying key 226 corresponding to the lower side of the smallest rectangle 230 that corresponds to the pattern 151 is specified. In other words, it is specified that another pattern, whose reference pattern is the pattern 151, exists in a direction adjacent to the lower side of the pattern 151. In the present embodiment, in order to easily visually check the additional reference, the line segment 235 is displayed in green.

In a case where none of the additional specifying keys is selected (NO at step S204) or after the additional reference is set as described above (step S205), it is determined whether the CLOSE key 227 is selected (step S206). If the CLOSE key 227 is not selected (NO at step S206), the processing returns to step S202. If the CLOSE key 227 is selected (YES at step S206), the pattern connection setting processing shown in FIG. 9 ends, and the CPU 61 returns to the main processing shown in FIG. 5.

As shown in FIG. 5, in the main processing, after the pattern connection setting processing (step S20), a screen (not shown in the drawings) including the sewing start key is displayed on the LCD 7, and it is determined whether the sewing start command of the N-th pattern is input (step S21). The CPU 61 stands by as long as the sewing start key is not selected (NO at step S21, step S21). In a case where the sewing start key is selected (YES at step S21), sewing of the N-th pattern is performed in accordance with the sewing data of the N-th pattern (step S22). Operations of the sewing machine 1 during sewing are the same as those at step S13.

Next, although not shown in the drawings, a message confirming whether or not to proceed to processing to sew the next pattern (the (N+1)-th pattern), an OK key, and a CANCEL key are displayed on the LCD 7. In a case where the CANCEL key is selected or in a case where the OK key is not selected within a predetermined time period (within five minutes, for example) (NO at step S23), the CPU 61 does not proceed to the processing of the next pattern and the main processing ends. In a case where the OK key is selected (YES at step 23), the marker detection processing is performed (step S30, FIG. 11). The marker detection processing is processing that, in the N-th holding position corresponding the already sewn N-th pattern, acquires image data of a captured image including the marker 110 arranged in accordance with the first reference of the N-th pattern, and associates the layout of the marker 110 in the N-th holding position with the first reference.

Figure 11:
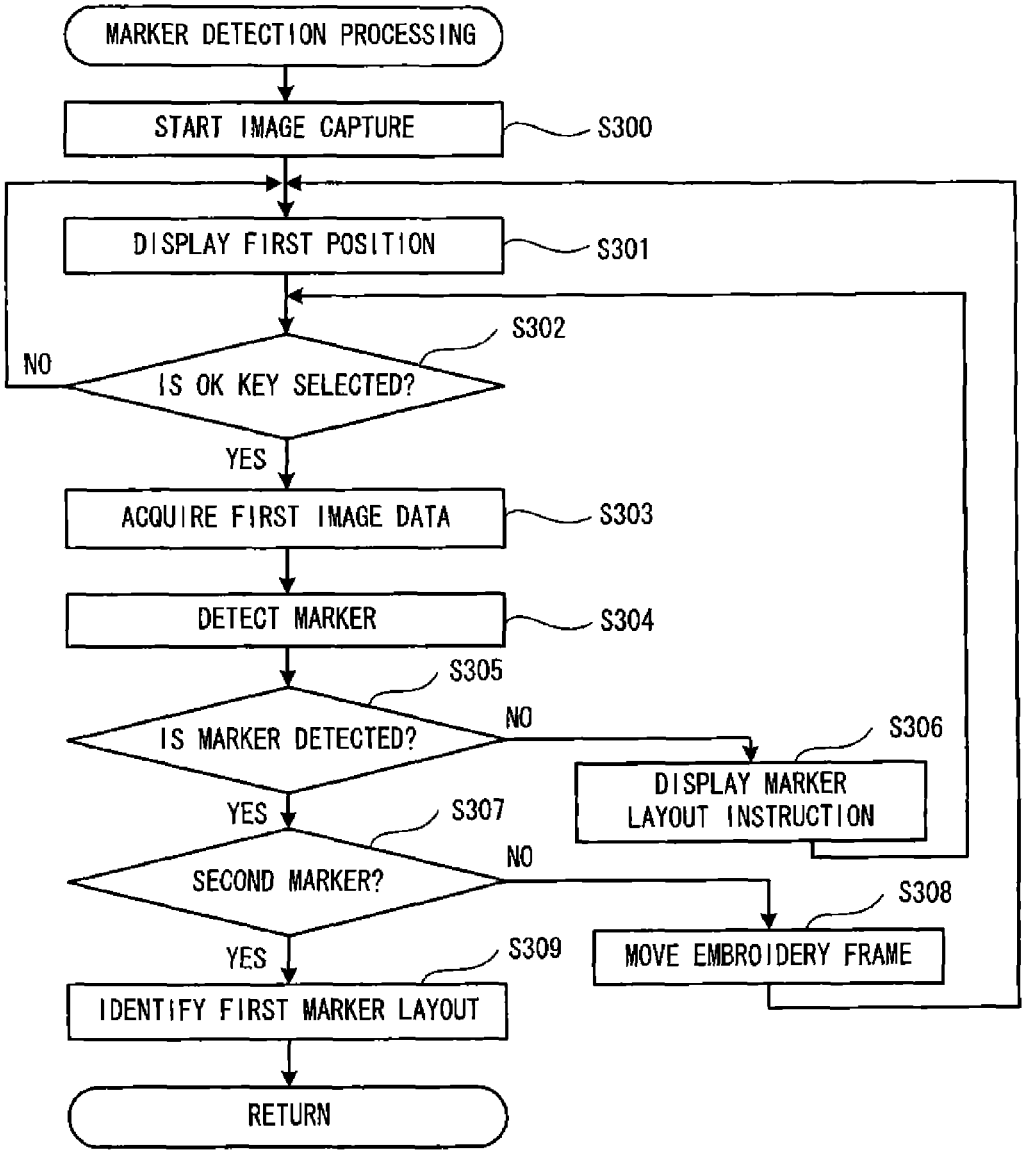
FIG. 11 is a flowchart of marker detection processing that is performed in the main processing.

As shown in FIG. 11, in the marker detection processing, first, the image sensor 50 is moved to an image capture position, and image capture of an area including the needle hole 36 (refer to FIG. 1) is started by the image sensor 50 (step S300). Then, the embroidery frame 84 is moved to such a position that a first position falls within the image capture area 180 (refer to FIG. 2). The first position is a position at which the marker 110 is to be arranged on the sewing object 39 and which is set in accordance with the first reference. Then, an image in which the first position has been identified is displayed on the LCD 7 (step S301). It is sufficient that the first position is determined as a position which is within the sewing area 86 in the N-th holding position and which is in the vicinity of a section adjacent to the next pattern (the continuous pattern), based on the layout of the line segment 231 included in the first reference or based on the layout of the line segment 231 and the point 232.

Figure 12:
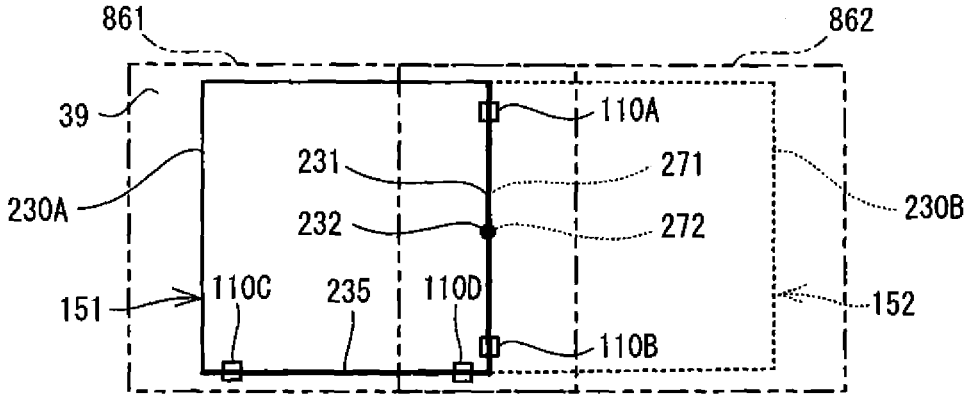
FIG. 12 is an explanatory diagram illustrating a layout of an already sewn pattern and a next pattern.

In the present embodiment, the processing is performed using two of the markers 110. The first positions are determined as areas which are within the sewing area 86 in the N-th holding position and on the line segment 231 included in the first reference and which are located at positions separated from both the ends of the line segment 231 by the size (the vertical length or the horizontal length) of the marker 110. It is preferable that the size of the area is set to be larger than the size of the marker 110 (for example, 1.5 times the size of the marker 110) so that the marker 110 can be easily affixed. In a case where the first reference of the first pattern 151 is set as shown in FIG. 10, areas 110A and 110B may be determined as the first positions as shown in FIG. 12. The areas 110A and 110B are located within a sewing area 861 that is set for the first holding position that corresponds to the pattern 151, and the areas 110A and 110B are located on the right side of a smallest rectangle 230A such that the areas 110A and 110B are separated from both the ends of the right side by the size of the marker 110. As described above, in the embroidery coordinate system 100 in the first holding position, the coordinates representing the line segment 231 have been identified. It is therefore possible to identify coordinates representing the areas 110A and 110B based on the coordinate data representing the line segment 231 and on the sewing data of the pattern 151.

Figure 13:
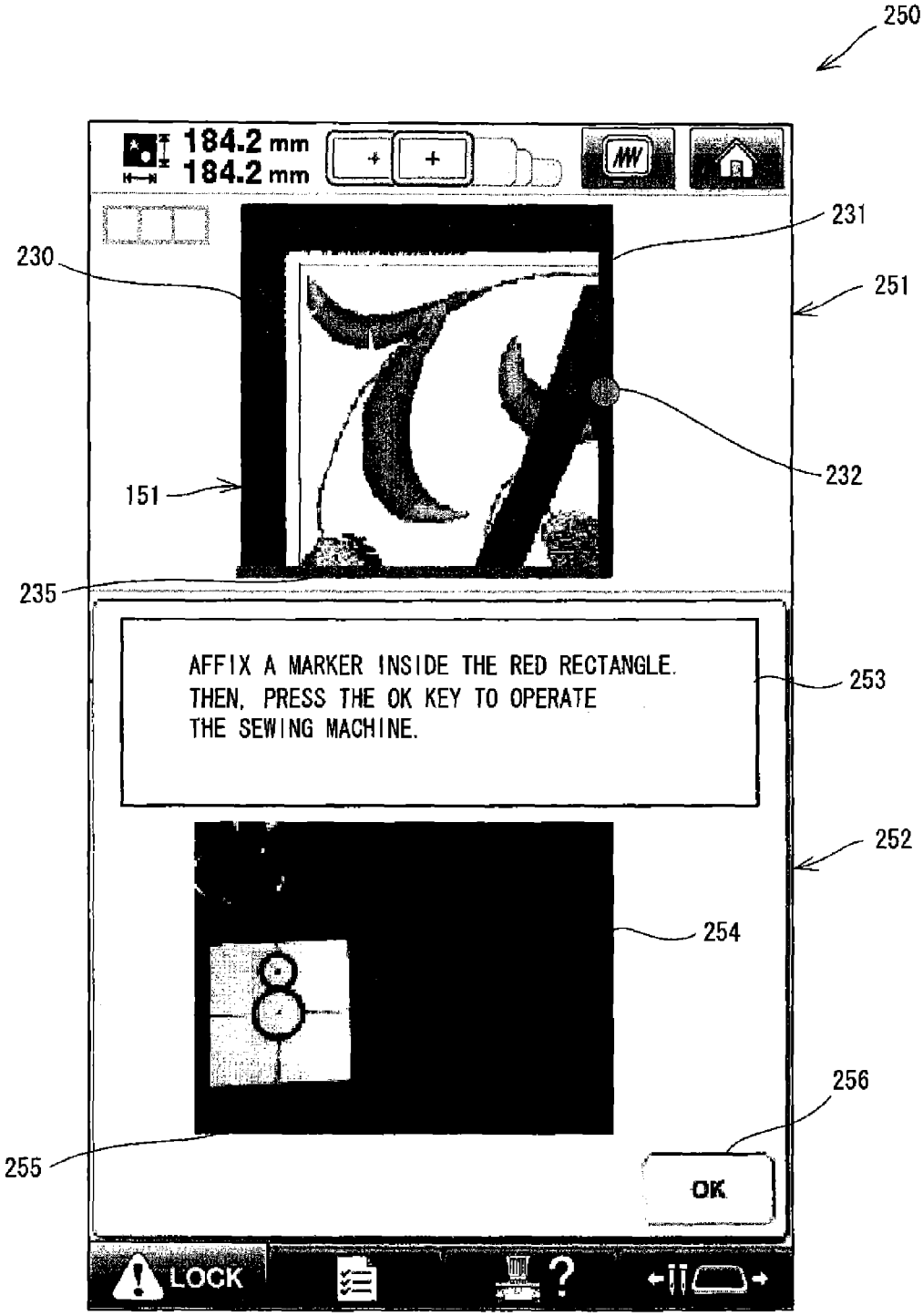
FIG. 13 is an explanatory diagram of a marker layout screen.

At step S301, first, the embroidery frame 84 is moved to a position in which one (for example, the area 110A) of the two first positions (the areas 110A and 110B) that have been determined as described above falls within the image capture area 180 of the image sensor 50. Then, an image in which the first position (the area 110A) is identified is displayed on the LCD 7. Specifically, a marker layout screen 250 exemplified in FIG. 13 is displayed on the LCD 7. As shown in FIG. 13, the marker layout screen 250 includes a pattern display column 251 and a layout command column 252. The pattern display column 251 is similar to the above-described pattern display column 221 (refer to FIG. 10). The layout command column 252 includes a message column 253, a composite image 254, and an OK key 256.

The composite image 254 is an image obtained by adding a red rectangle 255 to the captured image of the area including the needle hole 36 output from the image sensor 50. In the processing that detects the first marker 110, the red rectangle 255 may be displayed, in the image of the area including the needle hole 36, in a position that corresponds to one (the area 110A) of the areas 110A and 110B indicating marker layout positions. A message that prompts the user to select the OK key 256 is displayed in the message column 253 after the marker 110 is arranged in an area inside the rectangle 255. While confirming the layout command column 252, the user may affix the marker 110 such that the marker 110 can be arranged within the area inside the rectangle 255 on the sewing object 39. As long as the OK key 256 is not selected, the processing that updates and displays the composite image 254 using the image captured by the image sensor 50 is repeated (NO at step S302, step S301).

The user may confirm that the marker 110 is affixed to the inside of the rectangle 255 and may select the OK key 256. In a case where the OK key 256 is selected (YES at step S302), the image data output from the image sensor 50 is acquired and stored in the RAM 63 as first image data (step S303). Next, the processing is performed that detects the marker 110 from an image of the section corresponding to the inside of the rectangle 255 (step S304). At step S304, in a case where the marker 110 is detected from the image of the section corresponding to the inside of the rectangle 255, coordinates of the embroidery coordinate system 100 for the first center point 111 and the second center point 112 included in the marker 110 are identified.

The detection of the marker 110 and the identification of the coordinates may be performed using a known method. For example, Japanese Laid-Open Patent Publication No. 2010-246885 discloses the marker detection and the coordinate identification, the relevant portions of which are incorporated by reference. Specifically, two-dimensional coordinates in an image coordinate system, which is a coordinate system of the image captured by the image sensor 50, may be calculated for the first center point 111 and the second center point 112 of the marker 110, using the Hough conversion processing, for example. After that, the two-dimensional coordinates of the image coordinate system may be converted to three-dimensional coordinates of the world coordinate system. As described above, in the present embodiment, the embroidery coordinate system 100 and the world coordinate system are associated with each other. Therefore, coordinates of the embroidery coordinate system 100 may be calculated based on the three-dimensional coordinates of the world coordinate system calculated by the image processing.

If the marker 110 is not detected at step S304 (NO at step S305), a message that instructs the user to arrange the marker 110 in the rectangle 255 is displayed on the LCD 7 (step S306). After that, the processing returns to step S302. If the marker 110 is detected (YES at step S305), it is determined whether the detected marker 110 is the second marker 110 (step S307). The sewing machine 1 according to the present embodiment detects the two markers 110 that are respectively affixed to the positions corresponding to the areas 110A and 110B, and associates the layout of the markers 110 with the layout of the first reference in the N-th holding position. Therefore, in a case where the detected marker 110 is the first marker 110 (NO at step S307), the control signal is output to the drive circuits 131 and 133, so that the embroidery frame 84 is moved to a position to detect the second marker 110 (step S308). Specifically, the embroidery frame 84 is moved to a position in which one of the areas 110A and 110B (the area 110B) that is different from the area used in the processing of the first marker 110 falls within the image capture area 180 of the image sensor 50.

The processing returns to step S301, and the processing to detect the second marker 110 is performed (steps S301 to S306). At step S301 of the processing to detect the second marker 110, the red rectangle 255 may be displayed in a position corresponding to the area 110B. In a case where the second marker 110 is detected in a similar manner (YES at step S307), the layout (the position and the angle) of the markers 100 with respect to the first reference in the N-th holding position is identified based on coordinates of the detected two markers 110 and coordinates of the first reference (the line segment 231 and the point 232). Then, the identified layout of the markers 110 is stored in the RAM 63 as a first marker layout (step S309). In summary, the first marker layout is identified based on the first image data of two types of images that respectively include the two markers 110.

The layout of the markers 110 includes at least one of the position and the angle of the markers 110. The sewing machine 1 according to the present embodiment detects, as the layout of the markers 110, the position and the angle of the markers 110 based on coordinates of the embroidery coordinate system 100 of the first center points 111 of the two markers 110. The position of the markers 110 may be represented, for example, by the coordinates of the embroidery coordinate system 100 of the first center point 111 of one of the two markers 110. The angle of the markers 110 may be represented by an angle formed by the X-axis of the embroidery coordinate system 100 and a vector directing from the first center point 111 of the one of the two markers 110 toward the first center point 111 of the other marker 110. A distinction between the two markers 110 may be determined based on, for example, a relative position of the second center point 112 with respect to the first center point 111 in each of the markers 110. At step S309, the coordinates of the first center points 111 of the two markers 110 in the N-th holding position are associated with the coordinates representing the first reference (the line segment 231 and the point 232), for the N-th holding position, which is set and stored in the RAM 63 at step S203 of the pattern connection setting processing (FIG. 9), and thus the first marker layout is identified. The marker detection processing shown in FIG. 11 ends, and the CPU 61 returns to the main processing shown in FIG. 5.

As shown in FIG. 5, in the main processing, after the marker detection processing (step S30), it is determined whether there is the non-continuous adjacent pattern with respect to the N-th pattern (step S31). Specifically, in a case where the additional reference set by the pattern connection setting processing (step S20) is not stored in the RAM 63, it is determined that there is no non-continuous adjacent pattern (NO at step S31). In this case, in order to shift to the processing of the next pattern (the (N+1)-th pattern), the value of the variable N stored in the RAM 63 is incremented by one (step S41).

After that, the LCD 7 displays a screen (not shown in the drawings) including an OK key and a message that instructs the user to change the holding position of the sewing object 39 with respect to the embroidery frame 84, namely, a message that instructs the user to remove the sewing object 39 from the embroidery frame 84 and to rearrange the sewing object 39 (step S42). At this time, the holding position is changed in a state in which the two markers 110 are affixed to two locations, on the sewing object 39, that correspond to the first positions (the areas 110A and 110B shown in FIG. 12). Therefore, even if the holding position of the sewing object 39 by the embroidery frame 84 is changed, the layout of the markers 110 with respect to the sewing object 39 is not changed. The user may change the holding position and may select the OK key. In a case where the OK key is selected, the processing returns to step S2.

Figure 14:
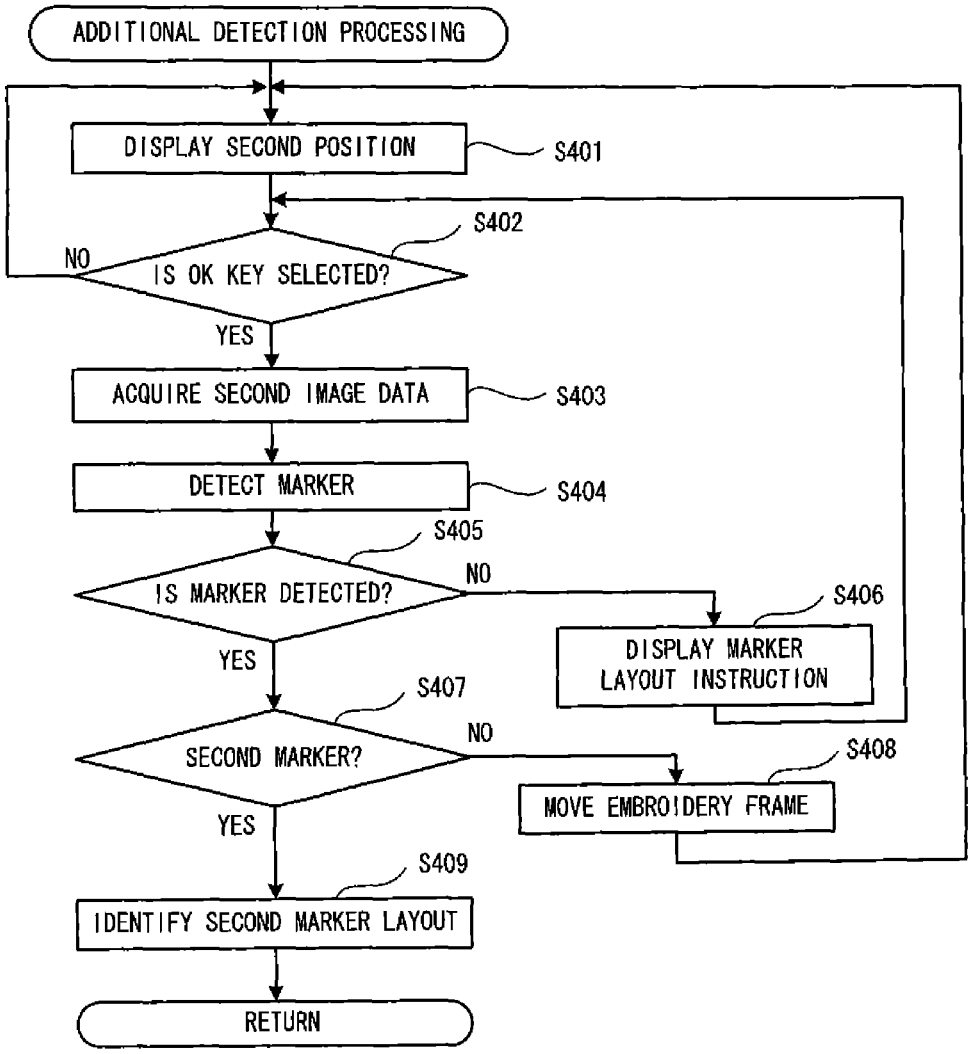
FIG. 14 is a flowchart of additional detection processing that is performed in the main processing.

On the other hand, in a case where the additional reference is stored in the RAM 63 and there is the non-continuous adjacent pattern with respect to the N-th pattern (YES at step S31), the additional detection processing is performed (step S40, FIG. 14). The additional detection processing is processing that acquires an image including the marker 110 that is arranged in accordance with the additional reference set for the N-th pattern in the N-th holding position, and associates the layout of the marker 110 in the N-th holding position with the layout of the additional reference. The processing content of steps S401 to S409 of the additional detection processing shown in FIG. 14 is almost the same as the processing content of steps S301 to S309 of the above-described marker detection processing, except that the position of the arranged marker 110 and the reference associated with the marker 110 are different. Therefore, hereinafter, the different processing content will mainly be explained, and the same processing content will be briefly explained or an explanation thereof will be omitted.

As shown in FIG. 14, in the additional detection processing, the embroidery frame 84 is moved to such a position that a second position falls within the image capture area 180 (refer to FIG. 2). The second position is a position at which the marker 110 is to be arranged on the sewing object 39 and which is set in accordance with the additional reference. Then, the LCD 7 displays a screen including an image in which the second positions have been identified (step S401). The screen that is displayed at this time is similar to the marker layout screen 250 shown in FIG. 13. It is sufficient that the second position is determined as a position which is within the sewing area 86 in the N-th holding position and which is in the vicinity of a section adjacent to the non-continuous adjacent pattern with respect to the N-th pattern, based on the layout of the line segment 235 included in the additional reference.

In the present embodiment, the second positions are determined as areas which are within the sewing area 86 in the N-th holding portion and on the line segment 235 that is the additional reference, and which are located at positions separated from both the ends of the line segment 235 by the size of the marker 110. It is preferable that the size of the area is set to be larger than the size of the marker 110 (for example, 1.5 times the size of the marker 110) so that the marker 110 can be easily affixed. In a case where the additional reference of the first pattern 151 is set as shown in FIG. 10, areas 110C and 110D are determined as the second positions as shown in FIG. 12. The areas 110C and 110D are located on the lower side of the smallest rectangle 230A that corresponds to the pattern 151 such that the areas 110C and 110D are separated from both the ends of the lower side by the size of the marker 110. As described above, in the embroidery coordinate system 100 in the first holding position corresponding to the first pattern 151, the coordinates representing the line segment 235 have been identified. It is therefore possible to identify coordinates representing the areas 110C and 110D based on the coordinate data representing the line segment 235 and on the sewing data of the pattern 151.

The marker 110 may be arranged in one (for example, the area 110C) of the second positions. Then, in a case where the OK key 256 is selected (YES at step S402), the image data output from the image sensor 50 is acquired and stored in the RAM 63 as second image data (step S403). After that, the processing until the two markers 110 are detected is the same as that of the marker detection processing (FIG. 9). In a case where the second marker 110 arranged in the other second position (the area 110D) is also detected (yes at step S407), the layout (the position and the angle) of the markers 100 with respect to the additional reference in the N-th holding position is identified based on coordinates of the detected two markers 110 and coordinates of the additional reference (the line segment 235), and the identified layout of the markers 110 is stored in the RAM 63 as a second marker layout (step S409). In summary, the second marker layout is identified based on the second image data of two types of images that respectively include the two markers 110. At step S409, the coordinates of the first center points 111 (refer to FIG. 4) of the two markers 110 in the N-th holding position are associated with the coordinates representing the additional reference (the line segment 235), in the N-th holding position, that is set and stored in the RAM at step S205 of the pattern connection setting processing (FIG. 9), and thus the second marker layout is identified. The additional detection processing shown in FIG. 14 ends, and the CPU 61 returns to the main processing shown in FIG. 5.

As shown in FIG. 5, in the main processing, after the additional detection processing (step S40), the value of the variable N is incremented by 1 (step S41). After that, the screen (not shown in the drawings) including the OK key and the message that instructs the user to change the holding position of the sewing object 39 with respect to the embroidery frame 84 is displayed (step S42). In a case where the processing at step S42 is performed after the additional detection processing is performed at step S40, the holding position may be changed in a state in which a total of four of the markers 110 are affixed to four locations on the sewing object 39, namely, two locations corresponding to the first positions and two locations corresponding to the second positions. In the example shown in FIG. 12, within the sewing area 861 set in the first holding position that corresponds to the pattern 151, the user may affix the four markers 110 to the areas 110A and 110B, which are the first positions, and to the areas 110C and 110D, which are the second positions. After that, the user may rearrange the sewing object 39 to a second holding position that corresponds to a sewing area 862 in which the pattern 152 can be sewn. The user may change the holding position and may select the OK key. In a case where the OK key is selected, the processing returns to step S2.

In the processing at step S2 after the variable N is set to 2 at step S41, the selection screen 200 (refer to FIG. 7) is displayed on the LCD 7 again. In a case where the second pattern (for example, the pattern 152) is selected (YES at step S2), sewing data of the second pattern is acquired (step S3). In a case where one of the patterns from the second pattern onwards is the processing target, the variable N is not 1 (NO at step S4). Therefore, the layout determination processing is performed (step S10, FIG. 15). In the example in which the patterns 151 to 154 shown in FIG. 6 are sequentially sewn, all the patterns from the second pattern onwards are continuous patterns of a preceding pattern (a (N−1)-th pattern). In the layout determination processing, the positioning of the continuous pattern with respect to the preceding pattern is performed in the N-th holding position that corresponds to the continuous pattern, and the layout of the continuous pattern is determined. At this time, if the continuous pattern is the non-continuous adjacent pattern of the already sewn reference pattern, the sewing data of the non-continuous adjacent pattern is corrected so that the continuous pattern is also accurately positioned adjacent to the reference pattern.

Figure 15:
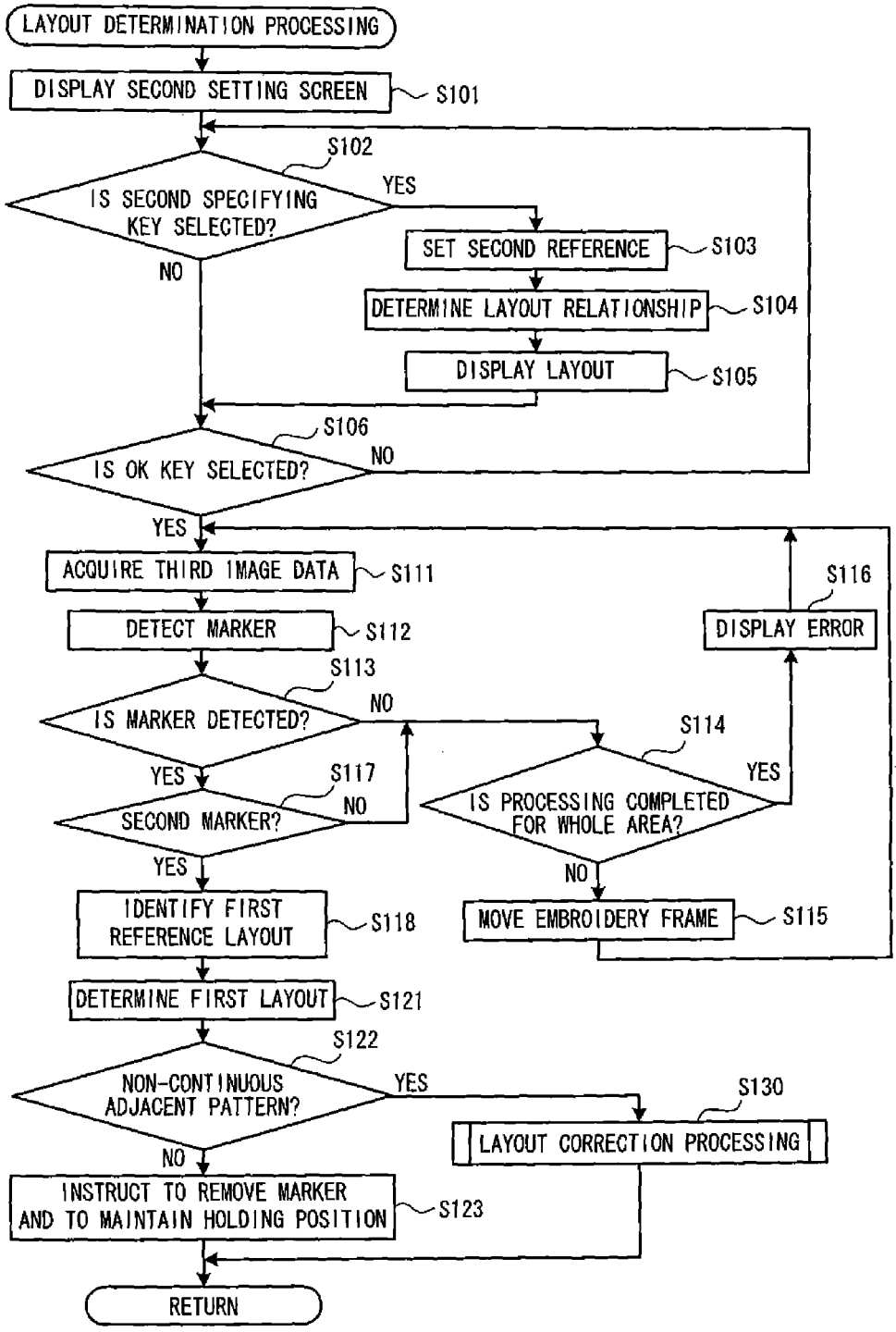
FIG. 15 is a flowchart of layout determination processing that is performed in the main processing.
Figure 16:
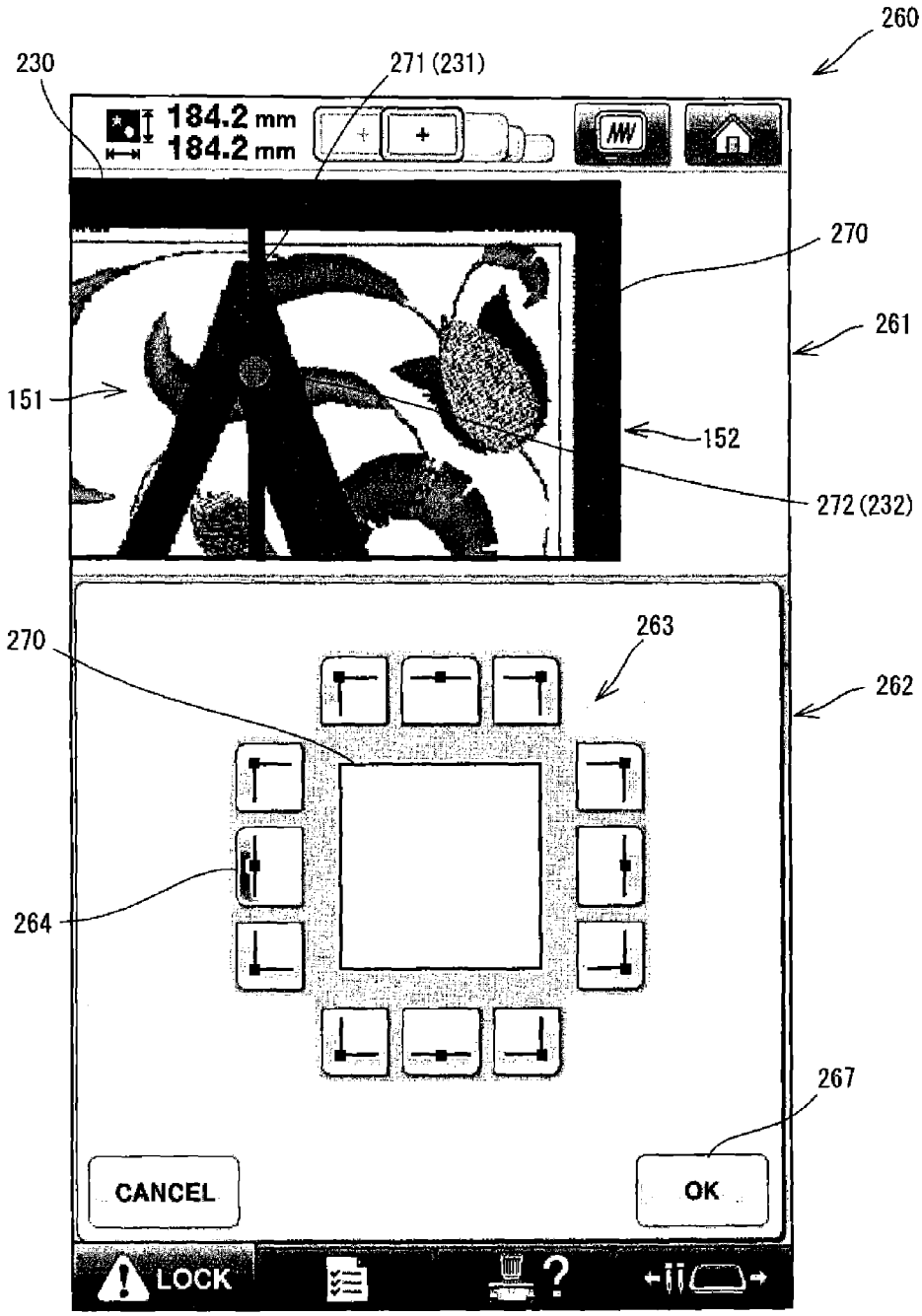
FIG. 16 is an explanatory diagram of a second setting screen.

As shown in FIG. 15, in the layout determination processing, first, a second setting screen 260 exemplified in FIG. 16 is displayed (step S101). The second setting screen 260 is a screen for setting a second reference. The second reference is a reference relating to the N-th pattern, and is used for determining a relative layout relationship between the N-th pattern (the continuous pattern of the (N−1)-th pattern), which is a processing target at this point in time, and the preceding pattern (the (N−1)-th pattern), which has already been sewn in an adjacent position. As shown in FIG. 16, the second setting screen 260 includes, for example, a pattern display column 261 and a command key column 262. The preceding pattern and the continuous pattern that is the processing target at this point in time are displayed in the pattern display column 261 in accordance with the set layout relationship. The command key column 262 includes a group of second specifying keys 263 and an OK key 267.

The group of second specifying keys 263 includes twelve second specifying keys that are used for specifying the second reference. In the present embodiment, a line segment 271 and a point 272 that are included in a second graphic are specified as the second reference. The second graphic is a graphic representing an area in which the continuous pattern is sewn. In the present embodiment, the second graphic is a smallest rectangle 270 in which the continuous pattern can be arranged. The smallest rectangle 270 is displayed in a central portion of the group of second specifying keys 263 arranged in a rectangular frame shape. The line segment 271 is selected from among four sides of the smallest rectangle 270. The point 272 is selected from among both end points of the second line segment 271 and a midpoint of the line segment 271. In the present embodiment, twelve second specifying keys are provided in accordance with twelve combinations of the line segment 271 and the point 272. The combination of the line segment 271 and the point 272 that corresponds to the selected one of the second specifying keys is set as the second reference. The OK key 267 in the command key column 262 is selected when the layout relationship between the preceding pattern (the (N−1)-th pattern) and the continuous pattern (the N-th pattern) of the preceding pattern is ascertained.

After the second setting screen 260 is displayed (step S101), it is determined whether one of the second specifying keys is selected from among the group of second specifying keys 263 (step S102). In a case where one of the second specifying keys (for example, a second specifying key 264) is selected (YES at step S102), the second reference (the line segment 271 and the point 272) specified by the second specifying key is set and stored in the RAM 63 (step S103). The layout of the second reference (the line segment 271 and the point 272) in the smallest rectangle 270 that corresponds to the N-th pattern can be identified by coordinates of the embroidery coordinate system 100 based on the sewing data of that pattern. The embroidery coordinate system 100 at this point in time is set with respect to the N-th holding position that corresponds to the N-th pattern (the continuous pattern of the (N−1)-th pattern). The identified layout of the line segment 271 and the point 272 in the N-th holding position is stored in the RAM 63.

A relative layout relationship between the preceding pattern (the (N−1)-th pattern) and the continuous pattern (the N-th pattern) of the preceding pattern is determined based on the first reference and the second reference, and is stored in the RAM 63 (step S104). The determined layout relationship between the preceding pattern and the continuous pattern is displayed on the LCD 7 (step S105). At step S105, the continuous pattern (the N-th pattern) and the second reference are displayed in the pattern display column 261, in accordance with a layout relationship corresponding to the second reference that is specified by the second specifying key with respect to the preceding pattern (the (N−1)-th pattern) in which the line segment 231 and the point 232 are overlapped and displayed. More specifically, the preceding pattern and the continuous pattern of the preceding pattern are arranged such that an extending direction of the line segment 231 of the first reference overlaps with the line segment 271 of the second reference and such that the point 232 of the first reference overlaps with the point 272 of the second reference. In the example shown in FIG. 16, as the second reference for the second pattern 152, which is the continuous pattern of the first pattern 151, the left side of the smallest rectangle 270 corresponding to the pattern 152 is specified as the line segment 271 and the midpoint of the left side is specified as the point 272. As a result, in the pattern display column 261, the patterns 151 and 152 are displayed that are arranged such that the left side (the line segment 271) of the pattern 152 overlaps with the right side (the line segment 231) of the smallest rectangle 230 that corresponds to the pattern 151 and such that the midpoint (the point 272) of the left side of the smallest rectangle 270 overlaps with the midpoint (the point 232) of the right side of the smallest rectangle 230.

In a case where none of the second specifying keys is selected (NO at step S102), or after the layout relationship is displayed (step S105), it is determined whether the OK key 267 is selected on the second setting screen 260 (step S106). If the OK key 267 is not selected (NO at step S106), the processing returns to step S102. If the relative layout relationship between the preceding pattern and the continuous pattern of the preceding pattern is ascertained by selection of the OK key 267 (YES at step S106), the processing for marker detection is performed. Specifically, the processing is performed that detects the two markers 110 that are arranged in the first positions in the vicinity of the adjacent section between the preceding pattern and the continuous pattern (the N-th pattern) in the marker detection processing (FIG. 11) for the preceding pattern (the (N−1)-th pattern). First, the image data output from the image sensor 50 is acquired as third image data (step S111). The detection processing of the markers 100 may be performed by using the whole image represented by the acquired third image data as a detection target (step S112). The detection of the markers 110 is performed using the known method in a similar manner to that at step S304 of the above-described marker detection processing (FIG. 11). In a case where the marker 110 is detected, coordinates of the embroidery coordinate system 100 of the first center point 111 and the second center point 112 of the marker 110 may be calculated, for example.

In a case where the marker 110 is not detected (NO at step S113), the whole area inside the embroidery frame 84 is set as a detection target area and it is determined whether the processing is completed (step S114). If there is an area that has not been set as the detection target area (NO at step S114), the control signal is output to the drive circuits 131 and 133, so that the embroidery frame 84 is moved to a position where the area that has not been set as the detection target area falls within the image capture area 180 of the image sensor 50 (step S115). The processing returns to step S111 and the processing that detects the marker 110 from the image is performed. The inside area of the embroidery frame 84 is sequentially processed in this way. If the processing is completed for the whole area without detecting the marker 110 (YES at step S114), an error message indicating that the two markers 110 cannot be detected is displayed on the LCD 7 (step S116). In this case, the user may confirm whether the two markers 110 are located in the inside area of the embroidery frame 84. The processing returns to step S111 and the processing that detects the marker 110 from the image is performed.

In a case where the marker 110 is detected (YES at step S113), it is determined whether the detected marker 110 is the second marker 110 (step S117). In the present embodiment, as the example shown in FIG. 12, in a case where, with respect to the preceding pattern (the pattern 151), there is not only the continuous pattern (the pattern 152) but also the non-continuous adjacent pattern, the four markers 110 may be affixed to the areas 110A to 110D. Therefore, depending on the changed holding position, there can be a case in which three or more of the markers 110 are arranged in the inside area of the embroidery frame 84. Thus, at step S117, the layout relationship between the two markers 110 may be identified, for example, based on the coordinates of the first center points 111 of the two markers 110 that are stored in the RAM 63 by the marker detection processing (FIG. 11) with respect to the preceding pattern (the (N−1)-th pattern). Then, in a case where the two markers 110 that satisfy the identified layout relationship are detected, it may be determined that the second marker 110 is detected.

If the detected marker 110 is not the second marker 110 (NO at step S117), the processing proceeds to step S114. As described above, until the marker 110 is detected, the image is acquired in the inside area of the embroidery frame 84 by moving the embroidery frame 84, and the processing that detects the second marker 110 is performed. The processing is repeated, and if the second marker 110 is detected (YES at step S117), the layout of the first reference in the N-th holding position is identified based on coordinates of the embroidery coordinate system 100 of the detected marker 110 in the N-th holding position and on the first marker layout stored in the RAM 63. The identified layout of the first reference is stored in the RAM 63 as a first reference layout (step S118). In summary, the first reference layout is identified based on the first marker layout identified based on the first image data, and based on the third image data.

For example, as shown in FIG. 12, in a case where the holding position is changed from the first holding position, which has been used when the preceding pattern (the pattern 151) corresponding to the sewing area 861 has been sewn, to the second holding position, in which the continuous pattern (the pattern 152) corresponding to the sewing area 862 is to be sewn, the first marker layout has already been stored in the RAM 63. That is, an associated relationship between the first reference and the markers 110 in the first holding position is identified. Further, at a point in time at which the holding position is changed to the second holding position that corresponds to the pattern 152, the embroidery coordinate system 100 in the second holding position is set. The coordinates of the markers 110 are identified by the above-described processing at steps S111 to S118. Therefore, in a case where the coordinates of the first reference (the line segment 231 and the point 232) in the first holding position are converted to coordinates in the second holding position, the coordinates of the first reference in the second holding position can be identified. In summary, the layout of the first reference (the first reference layout) in the second holding position can be identified.

Next, the layout of the N-th pattern (the continuous pattern of the (N−1)-th pattern) with respect to the sewing object 39 in the N-th holding position is determined based on the first reference layout identified at step S118, the relative layout relationship between the (N−1)-th pattern (the preceding pattern) and the N-th pattern (the continuous pattern), and the sewing data of the (N−1)-th pattern and the N-th pattern (step S121). More specifically, the layout of the N-th pattern with respect to the sewing object 39 in the N-th holding position is determined by correcting the sewing data of the N-th pattern based on the coordinates of the first reference (the line segment 231 and the point 232) of the embroidery coordinate system 100 in the N-th holding position and on the layout relationship between the first reference and the second reference (the line segment 271 and the point 272). The layout of the continuous pattern that is determined at step S121 based on the first reference layout, the layout relationship between the (N−1)-th pattern (the preceding pattern) and the N-th pattern (the continuous pattern), and the sewing data of the (N−1)-th pattern and the N-th pattern is referred to as a first layout.

After the layout of the N-th pattern is determined (step S121), it is determined whether the processing target N-th pattern is the non-continuous adjacent pattern in a case where another pattern that already been sewn is taken as the reference pattern (step S122). This determination is made, for example, in the following manner. In the main processing (FIG. 5), regarding the pattern that has been sewn at step S22 after the pattern connection setting processing at step S20, the sewing data of that pattern in the initial layout, and the first reference and the second reference set for that pattern are stored in the RAM 63 as data to identify the already sewn pattern. In a case where the pattern connection setting processing is performed a plurality of times and a plurality of patterns are sequentially connected and sewn, data of the plurality of patterns are sequentially accumulated every time the sewing is performed. At step S122, in a case where the patterns are connected and arranged up to the N-th pattern in the same embroidery coordinate system 100 based on the first reference and the second reference that are set for each of the patterns on the basis of the sewing data of the first pattern in the initial layout, if, in addition to the (N−1)-th pattern, there is another pattern whose boundary is in contact with the N-th pattern, it can be determined that the N-th pattern is the non-continuous adjacent pattern of that pattern.

In a case where the N-th pattern is not the non-continuous adjacent pattern of another pattern that has already been sewn (NO at step S122), the LCD 7 displays a message (not shown in the drawings) that instructs the user to remove the marker 110 and to maintain the holding position as it is (step S123). The marker 110 to be removed here are only the marker 110 that has been affixed to the first position in the vicinity of the adjacent section with the preceding pattern. After that, the LCD 7 displays a screen (not shown in the drawings) including the sewing start key and the pattern connecting key. The layout determination processing shown in FIG. 15 ends, and the processing returns to the main processing shown in FIG. 5. As shown in FIG. 5, in the main processing, after the layout determination processing (step S10), in a case where the sewing start key is selected (NO at step S11, YES at step S12), the sewing of the N-th pattern is performed (step S13), and then the main processing ends. On the other hand, in a case where the user desires to further connect and sew another pattern, the user may select the pattern connecting key. In a case where the pattern connecting key is selected (YES at step S11), the processing proceeds to step S20, and the processing to connect the next pattern is further continued.

Figure 17:
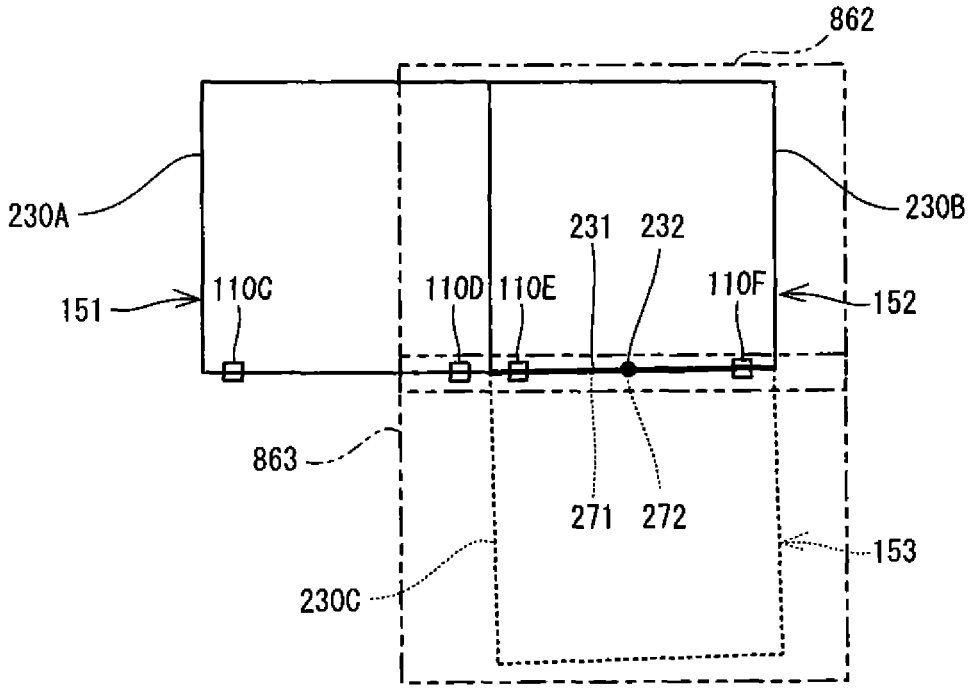
FIG. 17 is an explanatory diagram illustrating a layout of an already sewn pattern and a next pattern.

In an example in which the pattern 150 shown in FIG. 6 is finally formed, after the layout determination processing of the second pattern 152 (step S10 in FIG. 5), the pattern connection setting processing is performed to connect the third pattern 153 (YES at step S11, step S20). In this case, as shown in FIG. 17, the user may specify a lower side of a smallest rectangle 230B that corresponds to the pattern 152 and a midpoint of the lower side, as the line segment 231 and the point 232 of the first reference to connect the pattern 153 (step S203 in FIG. 9). There is no non-continuous adjacent pattern with respect to the pattern 152. Therefore, the pattern connection setting processing ends without specifying the additional reference. The pattern 152 is sewn in the second holding position that corresponds to the sewing area 862 (step S22 in FIG. 5). After that, in the marker detection processing (step S30), as shown in FIG. 17, the two markers 110 may be respectively affixed to areas 110E and 110F, which are the first position in accordance with the first reference, and the two markers 110 are detected. Then, the layout of the markers 110 with respect to the first reference (the line segment 231 and the point 232) in the embroidery coordinate system 100 in the second holding position is identified as the first marker layout (step S309 in FIG. 11). After that, in order to sew the pattern 153, the holding position may be changed to a third holding position that corresponds to a sewing area 863 in a state in which the markers 110 remain affixed to the areas 110C, 110D, 110E, and 110F (step S42 in FIG. 5).

In the layout determination processing (step S10 in FIG. 5) of the third pattern 153, an upper side of a smallest rectangle 230C corresponding to the pattern 153 and a midpoint of the upper side may be specified as the line segment 271 and the point 272 of the second reference (step S103 in FIG. 15). In this case, as shown in FIG. 17, a relative layout relationship between the pattern 152 and the pattern 153 is determined as a layout in which the line segment 231 and the line segment 271 overlap with each other and the point 232 and the point 272 overlap with each other (step S104). The two markers 110 affixed to the areas 110E and 110F are detected (steps S112 to S117). Then, as the first reference layout, the layout of the first reference (the line segment 231 and the point 232) of the pattern 152 is identified by coordinates of the embroidery coordinate system 100 corresponding to the third holding position (step S118), Further, the first layout of the pattern 153 with respect to the sewing object 39 in the third holding position is determined (step S121). The pattern 153 corresponds neither to the non-continuous adjacent pattern of the pattern 151 nor to the non-continuous adjacent pattern of the pattern 152 (NO at step S121). Therefore, the markers 110 in the areas 110E and 110F are removed, and the layout determination processing of the third pattern 153 ends in a state in which the markers 110 in the areas 110C and 110D remain affixed and the holding position remains as the third holding position.

Figure 18:
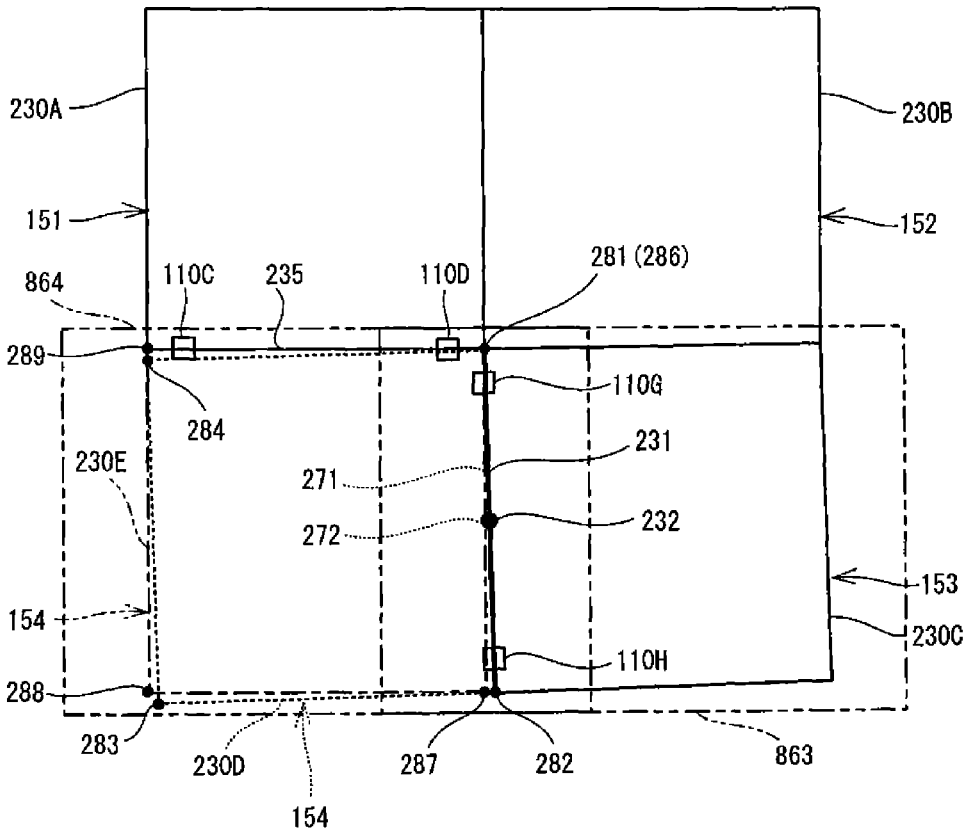
FIG. 18 is an explanatory diagram illustrating a layout of an already sewn pattern and a next pattern.

The pattern connection setting processing is performed to connect the fourth pattern 154 to the pattern 153 (YES at step S11, step S20 in FIG. 5). In this case, as shown in FIG. 18, the user may specify a left side of the smallest rectangle 230C that corresponds to the pattern 153 and a midpoint of the left side, as the line segment 231 and the point 232 of the first reference to connect the pattern 154 (step S203 in FIG. 9). There is no non-continuous adjacent pattern with respect to the pattern 153. Therefore, the pattern connection setting processing ends without specifying the additional reference. The pattern 153 is sewn in the third holding position that corresponds to the sewing area 863 (step S22 in FIG. 5). After that, in the marker detection processing (step S30), as shown in FIG. 18, the two markers 110 may be affixed to areas 110G and 110H, which are the first positions in accordance with the first reference, and the two markers 110 may be detected. Then, the layout of the markers 110 with respect to the first reference (the line segment 231 and the point 232) in the embroidery coordinate system 100 in the third holding position is identified as the first marker layout (step S309 in FIG. 11). After that, in order to sew the pattern 154, the holding position may be changed to a fourth holding position that corresponds to a sewing area 864 in a state in which the markers 110 remain affixed to the areas 110C, 110D, 110G and 110H (step S42 in FIG. 5).

In the layout determination processing (step S10 in FIG. 5) of the fourth pattern 154, as shown in FIG. 18, a right side of a smallest rectangle 230D corresponding to the pattern 154 and a midpoint of the right side may be specified as the line segment 271 and the point 272 of the second reference (step S103 in FIG. 15). In this case, a relative layout relationship between the pattern 153 and the pattern 154 is determined as a layout in which the line segment 231 and the line segment 271 overlap with each other and the point 232 and the point 272 overlap with each other (step S104). The two markers 110 affixed to the areas 110G and 110H are detected, and the layout of the first reference (the line segment 231 and the point 232) of the pattern 153 is identified, as the first reference layout, by coordinates of the embroidery coordinate system 100 corresponding to the fourth holding position (step S118). Further, the first layout of the pattern 154 (the smallest rectangle 230D) with respect to the sewing object 39 in the fourth holding position is determined (step S121).

Figure 19:
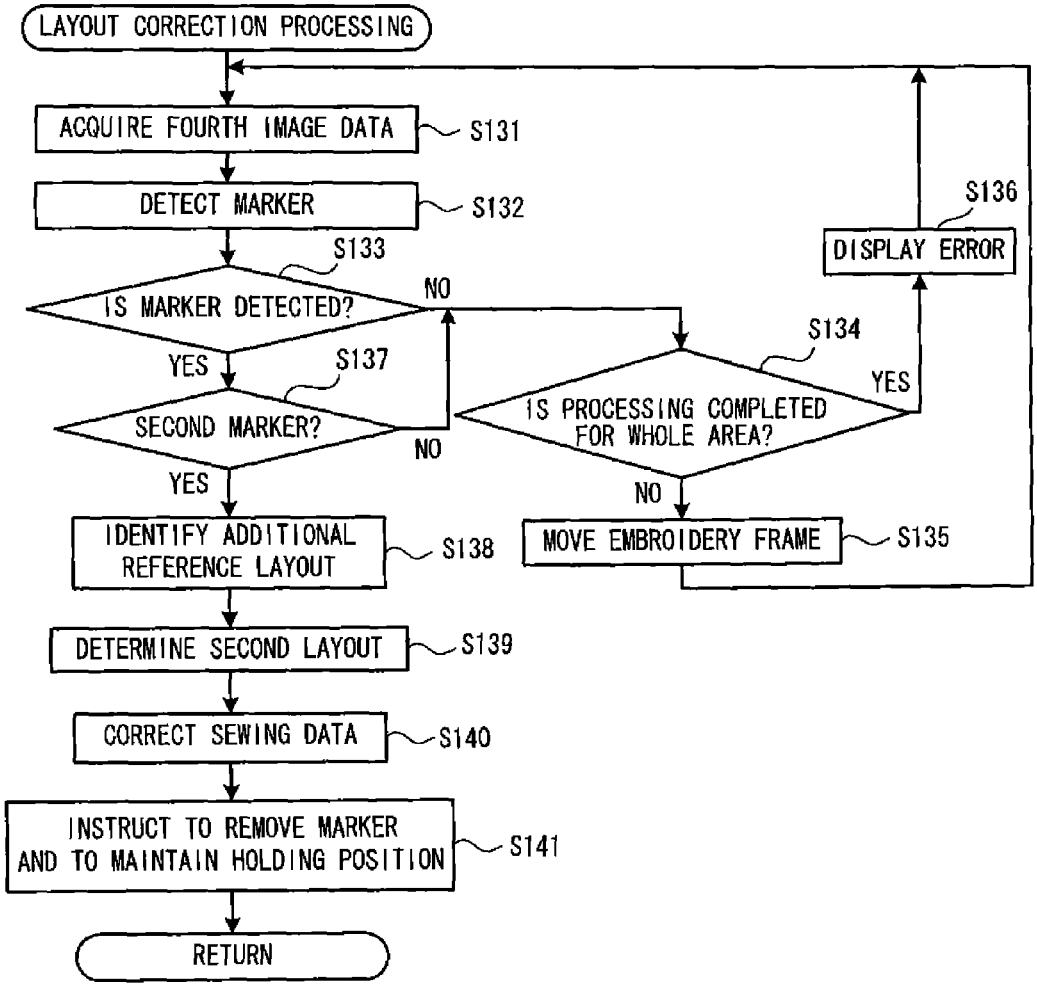
FIG. 19 is a flowchart of layout correction processing that is performed in the layout determination processing.

Next, it is determined that the pattern 154 is the non-continuous adjacent pattern with respect to the pattern 151, based on the sewing data of the patterns 151, 152, and 153 that is stored in the RAM 63, the sewing data of the pattern 154, and the first reference and the second reference that are set for each pattern (YES at step S122). In this case, the layout correction processing is performed (step S130, FIG. 19). The layout correction processing is performed in a case where the processing target N-th pattern is the non-continuous adjacent pattern when another pattern that has been already sewn is taken as the reference pattern. As shown in FIG. 19, in the layout correction processing, taking the whole inside area of the embroidery frame 84 as a target, the processing is performed that detects the two markers 110 that have been arranged in the second position in the vicinity of the adjacent section between the reference pattern and the non-continuous adjacent pattern (the N-th pattern) by the additional detection processing (step S40 in FIG. 5) after sewing the reference pattern. Specifically, first, the image data output from the image sensor 50 is acquired as fourth image data (step S131).

At subsequent steps S132 to S137, the content of the processing that detects the two markers 110 is the same as the content of the processing at steps S112 to S117 in the layout determination processing (FIG. 15), and an explanation thereof is thus omitted here. As in the example shown in FIG. 18, when this processing is performed, the markers 110 may have already been affixed not only to the areas 110C and 110D, which are the second positions, but also to the areas 110G and 110H, which are the first positions in the vicinity of an adjacent section between the processing target pattern (the pattern 154) and the preceding pattern (the pattern 153). Therefore, the four markers 110 may be arranged in the inside area of the embroidery frame 84. Thus, at step S137, the layout relationship between the two markers 110 may be identified, for example, based on the coordinates of the first center points of the two markers 110 that are stored in the RAM 63 by the additional detection processing (FIG. 14) with respect to the already sewn reference pattern (the pattern 151 in the example shown in FIG. 18). Then, in a case where the two markers 110 that satisfy the identified layout relationship are detected, it may be determined that the second marker 110 is detected.

The processing is repeated, and in a case where the second marker is detected (YES at step S137), the layout of the additional reference in the N-th holding position is identified based on coordinates of the embroidery coordinate system 100 of the detected marker 110 in the N-th holding position and on the second marker layout stored in the RAM 63, and the identified layout of the additional reference is stored in the RAM 63 as an additional reference layout (step S138). In summary, the additional reference layout is identified based on the second marker layout identified on the basis of the second image data, and based on the fourth image data.

For example, as shown in FIG. 18, the second marker layout has already been stored in the RAM 63, in the first holding position corresponding to the sewing area 861 set in a case where the first pattern 151, which is the reference pattern, is sewn. That is, an associated relationship between the additional reference and the markers 110 in the first holding position is identified. Further, at a point in time at which the holding position is changed to the fourth holding position that corresponds to the fourth pattern 154, the embroidery coordinate system 100 in the fourth holding position is set. The coordinates of the markers 110 are identified by the above-described processing at steps S131 to S138. Accordingly, if the coordinates of the additional reference (the line segment 235) in the first holding position are converted to coordinates in the fourth holding position, it is possible to identify the coordinates of the additional reference in the fourth holding position. That is, the layout of the additional reference (the additional reference layout) in the fourth holding position can be identified.

Next, the layout of the N-th pattern with respect to the sewing object 39 in the N-th holding position is identified based on the additional reference layout identified at step S138, the layout relationship between the already sewn reference pattern and the N-th pattern that is the non-continuous adjacent pattern, and the sewing data of these patterns (step S139). More specifically, the layout of the N-th pattern with respect to the sewing object 39 in the N-th holding position is determined by correcting the sewing data of the N-th pattern based on the coordinates of the additional reference (the line segment 235) of the embroidery coordinate system 100 in the N-th holding position and on the layout relationship between the reference pattern and the non-continuous adjacent pattern. The layout of the non-continuous adjacent pattern that is determined at step S139 based on the additional reference layout, the layout relationship between the reference pattern and the non-continuous adjacent pattern, and the sewing data of the reference pattern and the non-continuous adjacent pattern is referred to as a second layout.

The layout relationship between the non-continuous adjacent pattern and the corresponding reference pattern can be identified in the same manner as in the determination at step S122 of the layout determination processing (FIG. 15). Specifically, in a case where the patterns are connected and arranged up to the N-th pattern in the same embroidery coordinate system 100 based on the first reference and the second reference that are set for each pattern on the basis of the sewing data of the first pattern in the initial layout, another pattern whose boundary is in contact with the N-th pattern in the additional reference (the line segment 271) is identified as the reference pattern. Then, the layout relationship between the non-continuous adjacent pattern and the corresponding reference pattern can be identified based on the layout relationship between the identified reference pattern and the non-continuous adjacent pattern.

In a case where the second layout is determined at step S139, the sewing data of the N-th pattern is corrected based on the determined second layout and on the first layout determined at step S121 of the layout determination processing (FIG. 15) (step S140).

As described above, the first layout is determined using the image data (the first image data and the third image data) of the markers 110 that are arranged in the first positions in the vicinity of the adjacent section between the already sewn preceding pattern and the continuous pattern to be sewn next. Therefore, according to the first layout, even if errors are accumulated while at least three patterns are sequentially sewn or if sewing shrinkage or twisting occurs in the sewing object 39, it is still possible to perform positioning such that the continuous pattern is positioned accurately adjacent to the preceding pattern. However, the continuous pattern may also be the non-continuous adjacent pattern of another pattern (the reference pattern) that has been sewn ahead of the preceding pattern. In such a case, the non-continuous adjacent pattern in the first layout may not be positioned accurately adjacent to the reference pattern due to error accumulation, sewing shrinkage, twisting, or the like.

On the other hand, the second layout is determined using the image data (the second image data and the fourth image data) of the markers 110 that are arranged in the second positions in the vicinity of the adjacent section between the already sewn reference pattern and the non-continuous adjacent pattern. Therefore, according to the second layout, even if errors are accumulated while at least three patterns are sequentially sewn or if sewing shrinkage or twisting occurs in the sewing object 39, it is still possible to perform positioning such that the non-continuous adjacent pattern is positioned accurately adjacent to the reference pattern. On the other hand, the non-continuous adjacent pattern may also be the continuous pattern of the preceding pattern that has been sewn one pattern ahead of the non-continuous adjacent pattern. The non-continuous adjacent pattern in the second layout may not be accurately adjacent to the preceding pattern due to error accumulation, sewing shrinkage, twisting, or the like.

In FIG. 18, the first layout and the second layout of the pattern 154 are respectively shown by the smallest rectangles 230D and 230E. As shown in FIG. 18, the smallest rectangle 230D corresponding to the first layout is arranged such that the second reference (the line segment 271 and the point 272 of the smallest rectangle 230D) of the pattern 154 overlaps with the first reference (the line segment 231 and the point 232 of the smallest rectangle 230C) of the preceding pattern 153. Thus, the smallest rectangle 230D is positioned such that the right side of the smallest rectangle 230D is accurately adjacent to the left side of the smallest rectangle 230C. However, although the upper side of the smallest rectangle 230D should overlap with the lower side of the smallest rectangle 230A that corresponds to the pattern 151, the upper side of the smallest rectangle 230D is separated from the lower side of the smallest rectangle 230A.

On the other hand, the smallest rectangle 230E corresponding to the second layout is arranged such that the upper side of the pattern 154 overlaps with the additional reference (the line segment 235 of the smallest rectangle 230A) of the reference pattern 151. Thus, the smallest rectangle 230E is positioned such that the upper side of the smallest rectangle 230E is accurately adjacent to the lower side of the smallest rectangle 230A. However, although the right side of the smallest rectangle 230E should overlap with the left side of the smallest rectangle 230C that corresponds to the preceding pattern 153, the right side of the smallest rectangle 230E is separated from the left side of the smallest rectangle 230C. In this manner, with only one of the first layout and the second layout, the pattern 154 may not be accurately positioned to be adjacent to both the pattern 151, which is the reference pattern, and to the preceding pattern 153, due to error accumulation, sewing shrinkage, twisting, or the like.

To address this, in the present embodiment, at step S140, the N-th pattern, which is the non-continuous adjacent pattern, is transformed based on the first layout and the second layout such that the N-th pattern is accurately adjacent both to the preceding pattern (the (N−1)-th pattern) and to the reference pattern. That is, the sewing data of the N-th pattern is corrected based on the first layout and the second layout.

Specifically, among four vertices 281, 282, 283, and 284 of the smallest rectangle 230 (the smallest rectangle 230D in the example shown in FIG. 18) corresponding to the N-th pattern in the first layout, the two vertices 281 and 282, which are located on both the ends of the line segment 271 specified as the second reference, and the vertex 283, which is originally located at a position separated from the reference pattern (the pattern 151 in the example shown in FIG. 18), are identified by coordinates of the embroidery coordinate system 100 corresponding to the N-th holding position. Further, among four vertices 286, 287, 288, and 289 of the smallest rectangle 230 (the smallest rectangle 230E in the example shown in FIG. 18) corresponding to the N-th pattern in the second layout, coordinates of the two vertices 286 and 289 that are located on both the ends of the line segment (the upper side of the smallest rectangle 230E in the example shown in FIG. 18) overlapping with the reference pattern are also identified. The vertices 281 and 286 are points identified by same coordinates. A square 230F (refer to FIG. 20) whose vertices are the points 281 (286), 282, 283, and 289 is identified.

The square 230F identified in this manner is set as an area in which the transformed N-th pattern is sewn. Then, the smallest rectangle (the smallest rectangle 230D in the example shown in FIG. 18) whose vertices are the points 281, 282, 283, and 284, which corresponds to the N-th pattern in the first layout determined at step S121, is transformed to the square 230F whose vertices are the points 281 (286), 282, 283, and 289. Accordingly, the coordinates representing all needle drop points included in the sewing data of the N-th pattern in the first layout are converted by any known method. For example, affine transformation can be used to convert the coordinates, but any other known method may be used.

At step S140, instead of the sewing data of the N-th pattern corresponding to the first layout, the sewing data of the N-th pattern corresponding to the second layout may be corrected. In this case, for example, in the example shown in FIG. 18, the smallest rectangle 230E corresponding to the pattern 154 in the second layout may be transformed to a square whose vertices are the points 281 (286), 282, 288, and 289. Accordingly, the coordinates representing all needle drop points included in the sewing data of the N-th pattern in the second layout may be converted by the affine transformation. Further, in order to position the pattern 154 accurately adjacent to both the preceding pattern 153 and to the reference pattern 151, it is necessary that the right side and the upper side of the pattern 154 respectively overlap with the left side of the smallest rectangle 230C of the pattern 153 and the lower side of the smallest rectangle 230A of the pattern 151. However, the lower side and the left side of the pattern 154 are not adjacent to other patterns. Therefore, among the four vertices of the square that shows an area in which the transformed pattern 154 is sewn, one point other than the points 281 (286), 282, and 289 may be set to another point (for example, a midpoint of a line that connects the point 283 and the point 288).

The sewing data of the N-th pattern is thus corrected (step S140). After that, the LCD 7 displays a message (not shown in the drawings) that instructs the user to remove all the markers 110 and to maintain the holding position as it is (step S141). The layout correction processing shown in FIG. 19 ends, and the processing returns to the layout determination processing shown in FIG. 15. The layout determination processing shown in FIG. 15 also ends, and the processing returns to the main processing shown in FIG. 5. After that, in the main processing, as described above, the processing is performed depending on which of the pattern connecting key and the sewing start key is selected.

Figure 20:
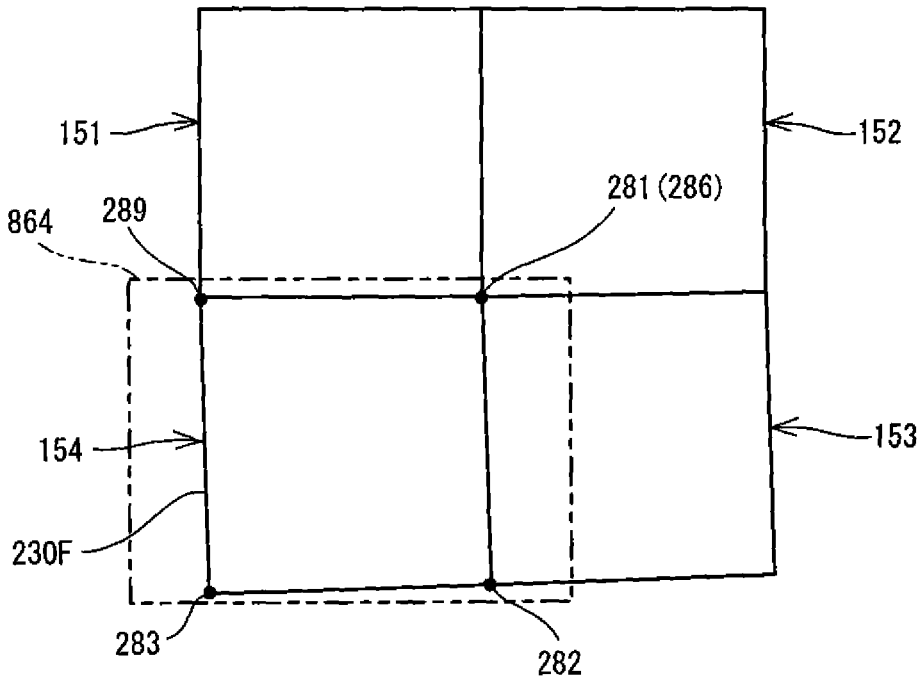
FIG. 20 is an explanatory diagram illustrating a pattern sewing result.

After that, in the example shown in FIG. 18, in a case where not the pattern connecting key but the sewing start key is selected and the sewing start is commanded (NO at step S11, YES at step S12), the transformed pattern 154 is sewn in the square 230F, in the fourth holding position corresponding to the sewing area 864, as shown in FIG. 20 (step S13). After that, the main processing ends.

As explained above, with the sewing machine 1 of the present embodiment, among at least three patterns that are sequentially sewn in adjacent positions, regarding the two patterns that are continuously sewn (the preceding pattern and the continuous pattern of the preceding pattern), the layout (the first layout) of the continuous pattern with respect to the sewing object 39 in the holding position corresponding to the continuous pattern is determined using the data (the first image data and the third image data) of two types of images which are captured in the holding positions respectively corresponding to the two patterns and which include the markers 110 arranged in the first positions in the vicinity of the adjacent section between the two patterns. It is thus possible to accurately perform positioning between the two patterns that are continuous.

Further, there are cases in which, in a position adjacent to one (the reference pattern) of the at least three patterns, there is another one (the non-continuous adjacent pattern) of the patterns that is sewn two or more patterns later than the one of the patterns in the sewing order. In such a case, the layout (the second layout) of the non-continuous adjacent pattern with respect to the sewing object 39 in the holding position corresponding to the non-continuous adjacent pattern is determined using the data (the second image data and the fourth image data) of two types of images which are captured in the holding positions respectively corresponding to the two patterns and which include the marker 110 arranged in the second positions in the vicinity of the adjacent section between the two patterns.

The non-continuous adjacent pattern of one of the patterns is also the continuous pattern of another one of the patterns. Therefore, as described above, the determination of the first layout is performed for the same pattern, using the first image data and the third image data. There may be a difference between the first layout and the second layout, namely, before the non-continuous adjacent pattern is sewn, slight errors may be accumulated, or sewing shrinkage or twisting of the work cloth may occur. In such a case, with the sewing machine 1 of the present embodiment, the sewing data of the continuous pattern, that is also the non-continuous adjacent pattern is corrected based on the first layout and the second layout. It is therefore possible to accurately position the non-continuous adjacent pattern with respect to the pattern to which the non-continuous adjacent pattern should be adjacent. In this manner, with the sewing machine 1 of the present embodiment, in a case where a plurality of patterns are sewn while changing the holding position of the sewing object 39 by the embroidery frame 84, it is possible to accurately perform positioning between the patterns that are not continuous in the sewing order.

Further, in the present embodiment, for the plurality of patterns that are to be continuously sewn, the user can set the layout relationship between the preceding pattern and the continuous pattern by specifying the first reference and the second reference by a panel operation. That is, the user can easily set the layout relationship between the preceding pattern and the continuous pattern as desired by the user. Further, in a case where there is the non-continuous adjacent pattern with respect to one of the patterns, by setting the additional reference by a panel operation, it is possible to easily identify that there is the non-continuous adjacent pattern that is adjacent in the direction desired by the user. Further, because the additional reference is identified in advance, the CPU 61 can notify the user to affix the markers 110 to the second positions at an appropriate timing.

The sewing machine of the present invention is not limited to the above-described embodiment, and various modifications may be made as in examples below.

For example, in the above-described embodiment, for the plurality of patterns that are to be sequentially sewn in adjacent positions, the first reference and the second reference to identify the layout relationship between the preceding pattern and the continuous pattern may be specified and set by the user performing a panel operation on the touch panel 8. However, as in the pattern shown in FIG. 6, in a case where a pattern larger than the largest sewing area 86 of the embroidery frame 84 is divided into a plurality of patterns, the layout relationship between the plurality of patterns may be determined in advance. Therefore, in such a case, settings relating to the layout relationship between the plurality of patterns may be set in advance and stored in the ROM 62 or EEPROM 64 such that the settings are included in sewing data of the plurality of divided patterns. In a case where the sewing machine 1 includes a connector that can be connected to an external storage device (a memory card, for example), sewing data stored in the external storage device may be read into the sewing machine 1 and used.

For example, in the example of the patterns 151 to 154 shown in FIG. 6, the sewing areas of the respective patterns 151 to 154 can be set to rectangles each having the same size. In addition to the coordinate data indicating the positions of the needle drop points, the sewing data of the respective patterns 151 to 154 can include information that indicates the positions of the rectangles corresponding to the respective patterns 151 to 154, as positions on a matrix including rows in the X-axis direction and columns in the Y-axis direction. Specifically, the patterns 151 to 154 are respectively shown as elements in the first row and the first column, in the first row and the second column, in the second row and the second column, and in the second row and the first column. In this case, since all the rectangles have the same size, if the rectangles are arranged based on the information indicating the positions of the rectangles included in the sewing data, it is possible to accurately arrange the patterns 151 to 154 in mutually adjacent positions. In this case, every time the patterns 151 to 154 are sequentially sewn, the user may not need to set the first reference and the second reference to connect the respective patterns 151 to 154. Further, from the settings included in the sewing data, it can be recognized that a relationship between the pattern 151 and the pattern 154 is that of the reference pattern and the non-continuous adjacent pattern. Therefore, the user may not need to set the additional reference. The sewing machine 1 can automatically perform appropriate positioning based on the settings included in the sewing data.

Without being limited to a case in which a large pattern is divided into a plurality of patterns, the settings (the first reference and the second reference, for example) that has been once set by the user in relation to the layout relationship between a plurality of patterns that are sequentially sewn in adjacent positions may be associated with the sewing data and stored in the EEPROM 64, in accordance with a user's command or automatically, when the main processing ends. In this case, the sewing machine 1 can thereafter continue to use the layout relationship set by the user and can automatically perform the appropriate positioning.

Figure 21:
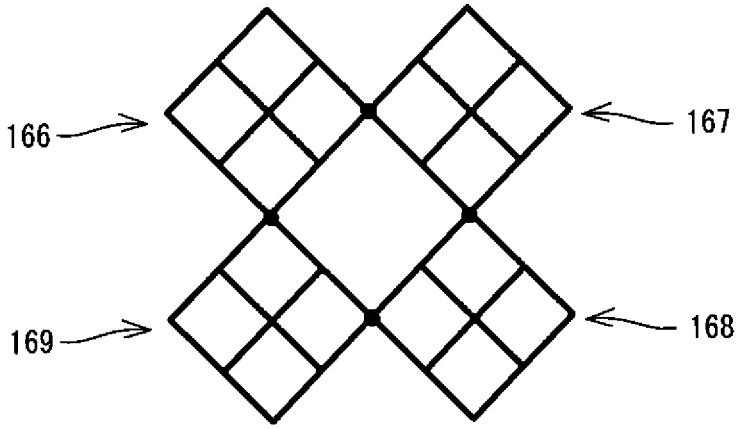
FIG. 21 is an explanatory diagram illustrating another layout example of patterns.

In the above-described embodiment, as an example in which two patterns (the preceding pattern and the continuous pattern, and the reference pattern and the non-continuous adjacent pattern) are sewn in adjacent positions, an example is explained in which the smallest rectangles of the two patterns have a common boundary. However, the two patterns may be formed such that the two patterns share a part of a side of the corresponding smallest rectangles. The two patterns may be formed such that the two patterns are in point contact with each other. In addition, as shown in FIG. 21, for example, in which four patterns 166 to 169 are sequentially sewn, even if each pattern is in contact with the next pattern by a single point, the processing of the above-described embodiment is possible.

It is sufficient that the layout of patterns includes at least one of the position and the angle of the patterns. The graphic representing an area (an estimated sewing area) in which a pattern is sewn may not necessarily be the corresponding smallest rectangle. The graphic representing the area in which the pattern is sewn may be, for example, one of a circle, an ellipse, and a polygon in which the pattern can be arranged. The line segment 231 of the first reference and the line segment 271 of the second reference may be a part of a contour of these graphics. It is sufficient that the point 232 of the first reference and the point 272 of the second reference are points included in these graphics. The point 232 of the first reference and the point 272 of the second reference may respectively be selected points on the line segment 231 and the line segment 271, or may be points that are not on the line segment 231 and the line segment 271.

In the embodiment, the sewing machine 1 having the plurality of needle bars 31 is shown as an example. However, an industrial sewing machine or a household sewing machine having a single needle bar may be used. The type and layout of the image sensor 50 may be changed as appropriate. For example, the image sensor 50 may be an imaging element other than the CMOS image sensor, such as a CCD camera.

The number of the markers 110 can be changed as appropriate. More specifically, the number of the markers 110 may be one or may be three or more. In a case where the layout of the patterns is identified based on a plurality of the markers 110, particularly, the angle can be accurately identified, in comparison to a case in which the single marker 110 is used. The layout of the marker 110 detected based on the image data may be at least one of the position and the angle of the marker 110. The configuration of the marker 110 may be changed as appropriate. The configuration of the marker 110 includes, for example, a size, a material, a design, and a color of the marker 110. The method for arranging the marker 110 on the sewing object 39 is not limited to affixing by adhesion. For example, the marker 110 may be attached to the sewing object 39 by a pin. The reference (the first center point 111 of the marker 110 in the above-described embodiment) to identify the layout of the marker 110, and its calculation method may be changed as appropriate, taking the configuration etc. of the marker 110 into consideration.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine capable of embroidery sewing, comprising:

an image capturing portion that is configured to capture an image of a sewing object held by an embroidery frame;

a setting acquisition portion that is configured to acquire individual settings relating to a layout relationship between two patterns that are to be continuously sewn, with respect to at least three patterns that are sequentially sewn in adjacent positions in accordance with a sewing order in states in which holding positions of the sewing object by the embroidery frame are each different;

a first image data acquisition portion that is configured to acquire first image data every time each of the at least three patterns is sewn in accordance with the sewing order, the first image data being image data of an image that includes a marker arranged in a first position and that is captured by the image capturing portion in a holding position corresponding to each of the at least three patterns, the first position being a position, on the sewing object, in a vicinity of an adjacent section with a continuous pattern, and the continuous pattern being another one of the at least three patterns that is next in the sewing order;

a second image data acquiring portion that is configured to acquire second image data in a case where there is a non-continuous adjacent pattern in a position adjacent to a reference pattern, the reference pattern being one of the at least there patterns, the second image data being image data of an image that includes a marker arranged in a second position and that is captured by the image capturing portion in a holding position corresponding to the reference pattern, the non-continuous adjacent pattern being another one of the at least three patterns that is sewn at least two patterns later than the reference pattern in the sewing order, and the second position being a position, on the sewing object, in a vicinity of an adjacent section with the non-continuous adjacent pattern;

a third image data acquisition portion that is configured to acquire third image data after the first image data corresponding to each of the at least three patterns is acquired in accordance with the sewing order, the third image data being image data of an image that includes the marker arranged in the first position and that is captured by the image capturing portion in a holding position corresponding to the continuous pattern;

a fourth image data acquisition portion that is configured to acquire fourth image data in a case where the continuous pattern corresponding to the third image data that has been acquired is also a non-continuous adjacent pattern of a reference pattern, the fourth image data being image data of an image that includes the marker arranged in the second position and that is captured by the image capturing portion in a holding position corresponding to the continuous pattern that is also the non-continuous adjacent pattern;

a first layout determination portion that, with respect to the continuous pattern of each of the at least three patterns, is configured to determine a first layout based on sewing data of the continuous pattern and of an immediately preceding pattern in the sewing order, the settings, the first image data, and the third image data, the first layout being a layout of the continuous pattern on the sewing object in the holding position corresponding to the continuous pattern;

a second layout determination portion that, with respect to the continuous pattern that is also the non-continuous adjacent pattern, is configured to determine a second layout based on sewing data of the non-continuous adjacent pattern and of the reference pattern, the settings, the second image data, and the fourth image data, the second layout being a layout of the continuous pattern that is also the non-continuous adjacent pattern on the sewing object in the holding position corresponding to the continuous pattern; and a sewing data correction portion that is configured to correct sewing data of the continuous pattern that is also the non-continuous adjacent pattern, based on the first layout and the second layout that have been determined with respect to the continuous pattern that is also the non-continuous adjacent pattern, such that the non-continuous adjacent pattern is adjacent to the reference pattern.

2. The sewing machine according to claim 1, further comprising:

an input portion that is configured to input information, wherein the setting acquisition portion is configured to acquire, as the settings, information relating to the layout relationship input via the input portion.

3. The sewing machine according to claim 1, wherein settings relating to layout relationships between the at least three patterns are included in sewing data of the at least three patterns, and the setting acquisition portion is configured to acquire the settings included in the sewing data.

* * * * *